US006220754B1

(12) United States Patent
Stiglic et al.

(10) Patent No.: US 6,220,754 B1
(45) Date of Patent: Apr. 24, 2001

(54) CLOSURE DEVICE AND SLIDER

(75) Inventors: Jeffrey S. Stiglic, Tinley Park; Michael G. Borchardt, Naperville, both of IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/149,944

(22) Filed: Sep. 9, 1998

(51) Int. Cl.[7] ..... B65D 33/25
(52) U.S. Cl. ..... 383/64; 24/415
(58) Field of Search ..... 383/64; 24/399, 24/400, 415, 417

(56) References Cited

U.S. PATENT DOCUMENTS

| | | | | |
|---|---|---|---|---|
| 3,054,434 | | 9/1962 | Ausnit et al. . | |
| 3,115,689 | | 12/1963 | Jacobs . | |
| 3,122,807 | | 3/1964 | Ausnit . | |
| 3,230,593 | | 1/1966 | Herz . | |
| 3,426,396 | | 2/1969 | Laguerre . | |
| 3,713,923 | | 1/1973 | Laguerre . | |
| 4,186,786 | | 2/1980 | Kirkpatrick . | |
| 4,199,845 | | 4/1980 | Ausnit . | |
| 4,262,395 | | 4/1981 | Kosky . | |
| 4,285,105 | | 8/1981 | Kirkpatrick . | |
| 4,736,496 | | 4/1988 | Fisher et al. . | |
| 4,747,702 | * | 5/1988 | Scheibner | 383/63 |
| 4,829,641 | | 5/1989 | Williams . | |
| 5,007,142 | | 4/1991 | Herrington . | |
| 5,007,143 | | 4/1991 | Herrington . | |
| 5,101,627 | | 4/1992 | Fujii et al. . | |
| 5,138,750 | | 8/1992 | Gundlach et al. . | |
| 5,140,727 | | 8/1992 | Dais et al. . | |
| 5,283,932 | | 2/1994 | Richardson et al. | 24/400 |
| 5,403,094 | | 4/1995 | Tomic . | |
| 5,405,478 | | 4/1995 | Richardson et al. . | |
| 5,426,830 | | 6/1995 | Richardson et al. | 24/430 |
| 5,664,299 | * | 9/1997 | Porchia et al. | 24/400 |
| 5,836,056 | | 11/1998 | Porchia et al. . | |
| 5,871,281 | * | 2/1999 | Stolmeier et al. | 383/64 |
| 5,953,796 | * | 9/1999 | McMahon et al. | 24/400 |
| 5,956,815 | * | 9/1999 | O'Connor et al. | 24/400 |
| 6,014,795 | * | 5/2000 | McMahon et al. | 24/400 |
| 6,088,887 | | 7/2000 | Bois | 24/399 |

FOREIGN PATENT DOCUMENTS

| | | |
|---|---|---|
| 0510797 | 3/1992 | (EP) . |
| 51-27719 | 8/1976 | (JP) . |

* cited by examiner

*Primary Examiner*—Stephen P. Garbe
(74) *Attorney, Agent, or Firm*—Thomas C. Feix

(57) ABSTRACT

A closure device with interlocking fastening strips and a slider which establishes a leak proof seal. The closure device comprises first and second interlocking fastening strips arranged to be interlocked over a predetermined length and a slider with a separator finger which slidably engages said first and second fastening strips. The first fastening strip includes a first closure element and the second fastening strip includes a second closure element. The slider facilitates the occlusion of the closure elements when moved towards a first end of the fastening strips. The separator finger extends into the closure elements without extending completely through the closure elements. The portion of the closure elements below the separator finger are occluded when the slider is at the first end of the fastening strips.

96 Claims, 20 Drawing Sheets

CLOSURE DEVICE AND SLIDER

FIELD OF THE INVENTION

The present invention pertains to an interlocking closure device, and, more particularly, to a closure device with a slider. The closure device of the present invention may be employed in traditional fastener areas, and is particularly suited for use as a fastener for storage containers, such as plastic bags.

BACKGROUND OF THE INVENTION

The use of fastening devices for the closure of containers, including plastic bag bodies, is generally known. Furthermore, the manufacture of fastening devices made of plastic materials is generally known to those skilled in the art relating to closure devices, as demonstrated by the numerous patents in this area.

A particularly well-known use for fastening devices is in connection with flexible containers, such as bag bodies. The closure device and the associated container may be formed from thermoplastic materials, and the closure device and sidewalls of the container can be integrally formed by extrusion as a single piece. Alternatively, the closure device and sidewalls may be formed as separate pieces and then connected by heat sealing or any other suitable connecting process. The closure devices when incorporated as fasteners on bag bodies have been particularly useful in providing a closure means for retaining the contents within the bag body.

Conventional closure devices utilize mating male and female closure elements which are occluded. When conventional closure devices are employed, it often is difficult to determine when the male and female closure elements are occluded. This problem is particularly acute when the closure devices are relatively narrow. Accordingly, when conventional closure devices are employed, there exists a reasonable likelihood that the closure device is at least partially open.

The occlusion problem arises from the inability of a user to perceive when the male and female closure are occluded to form a seal between the contents of the bag and the environment external to the bag. A number of solutions to this problem have been attempted. For example, U.S. Pat. Nos. 4,186,786, 4,285,105, and 4,829,641, as well as in Japanese patent application No. 51-27719, disclose fasteners that provide a visual indication that the male and female closure elements are properly occluded. Specifically, a color change means for verifying the occlusion of the male and female members of the closure is provided wherein male and female members having different-colors are employed, and, upon occlusion, provide yet a different color. For example, the female member of the closure may be opaque yellow and the male member of the closure may be translucent blue. Upon occlusion of the male member and female member a composite color with a green hue results. This use of a color change greatly improves the ability of the user of the interlocking closure device to determine when the male and female members are occluded.

The change in color that is viewed when dissimilarly colored male and female members are occluded is demonstrated in a commercially available product sold under the trademark GLAD-LOCK (Glad-Lock is the registered trademark of The Glad Products Company of Oakland, California, formerly First Brands Properties, Inc., Danbury, Conn.). This color change effect may be enhanced by the incorporation of a color change enhancement member in the closure device, as disclosed in U.S. Pat. No. 4,829,641.

Color-changing closure devices are not a universal solution to the aforementioned problem of assuring full closure, however. For example, the color-change effect is imperceptible in the dark, thus mooting the color-change advantage of the closure devices when they are used under such conditions. In addition, sight-impaired or color-blind people may not be able to perceive the color-change effect. Accordingly, it would be desirable to provide a closure device that affords other indications of occlusion.

The prior art has attempted to furnish a fastener that provides a tactile or audible indication of occlusion. For example, U.S. Pat. Nos. 4,736,496, 5,138,750, 5,140,727, 5,403,094, and 5,405,478, as well as EP 510,797, disclose closure devices that allegedly provide a tactually or audibly perceptive indication of proper interlocking of the closure elements. It is said that, upon occlusion of the disclosed closure devices, a user is able to feel or hear that full closure is accomplished. For example, U.S. Pat. No. 4,736,946 discloses the use of additional ribs on either side of the closure elements. These ribs are said to give an improved "feel" to the closure, thus aiding a user in aligning the closure elements.

Such devices are difficult to handle by individuals who have limited manual dexterity. Thus, in order to assist these individuals and for ease of use by individuals with normal dexterity, the prior art has attempted to furnish a fastener that provides a reclosable fastener and a slider for opening and closing the fastener. For example, several U.S. Patents disclose fasteners with sliders. However many of these fasteners use either: (1) a separator finger which extends between the closure elements, such as U.S. Pat. Nos. 3,054,434, 3,115,689, 3,122,807, 3,230,593, 3,426,396, 3,713,923, 4,199,845, 4,262,395, 5,007,142, and 5,010,627 (FIGS. 9 and 10); or (2) the separator finger runs along a track above the closure elements, such as, U.S. Pat. Nos. 5,007,143, 5,010,627 (FIGS. 3–8), 5,020,194, 5,067,208, 5,070,583, 5,088,971, 5,131,121, 5,161,286, 5,283,932, 5,301,395, 5,426,830, 5,442,837 and 5,448,808.

With respect to fasteners which use a separator finger which extends between the closure elements, these fasteners do not provide a leak proof seal because the separator finger extends between the closure elements. With respect to the fasteners which run along a track, the fastener typically include slits, notches or another means to accommodate the separator finger in the end position. These means are used to achieve occlusion of the closure elements at the end position and thus attempt to achieve a leak proof seal. For example, U.S. Pat. Nos. 5,020,194, 5,067,208, 5,088,971, 5,131,121, 5,161,286, 5,301,394, 5,301,395, and 5,442,837 use a slit, notch or other means to accommodate the separator finger in the end position. These means in the fasteners create additional steps in the manufacturing process and thus may increase the cost of these fasteners.

A reclosable fastener with a slider and without a separator finger nor the use of a track is described in U.S. Pat. Nos. 3,074,137 and 5,442,838. However, the fastener in the '137 patent would be too expensive to manufacture and may not seal when the slider is in the end position. With respect to the fastener in the '838 patent, the slider does not manipulate the interlocking elements directly. Rather, the slider engages the structure located below the interlocking elements to control the opening and closing of the interlocking elements. Difficulties and additional variables can arise when the slider does not act directly upon the interlocking elements. In addition, the fastener in the '838 patent may not operate properly if the tolerances are incorrect for the slider and/or the fastener. The structure below the interlocking elements and/or the slider may be difficult to extrude or manufacture. If the tolerances are incorrect, the slider may not move smoothly or fail to open or close the fastener elements. Thus, it would be difficult to achieve a properly functioning fastener.

Thus, the prior art has failed to afford a closure device with a slider and a separator finger which establishes a leak proof seal without the use of slits, notches or other means. It is a general object of the present invention to provide such a closure device. It is a further general object of the present invention to provide a container that is closeable and sealable by means of such a closure device.

BRIEF SUMMARY OF THE INVENTION

The present invention satisfies these general objects by providing a closure device with interlocking fastening strips and a slider which establishes a leak proof seal. The closure device comprises first and second interlocking fastening strips arranged to be interlocked over a predetermined length and a slider with a separator finger which slidably engages said first and second fastening strips. The first fastening strip includes a first closure element and the second fastening strip includes a second closure element. The slider facilitates the occlusion of the closure elements when moved towards a first end of the fastening strips and deocclusion of the closure elements when moved towards a second end of the fastening strips. The separator finger extends into the closure elements without extending completely through the closure elements. The portion of the closure elements below the separator finger are occluded when the slider is at the first end of the fastening strips.

DESCRIPTION OF THE EMBODIMENTS

The present invention provides interlocking closure devices with a slider which establishes a leak proof seal. As used herein and as generally understood in the art, the terms "male" and "female" closure elements refer to closure elements wherein the element that interlocks into the other closure element is referred to as the "male closure element" and the outer element is referred to as the "female closure element".

Figure 1:
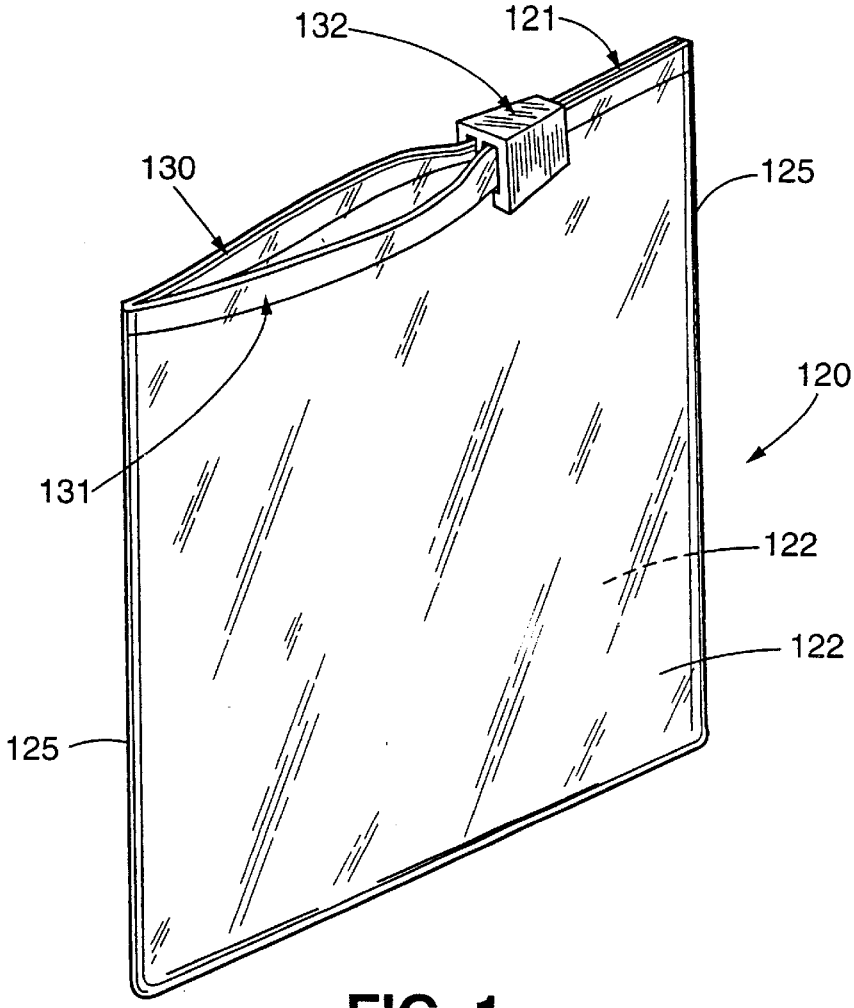
FIG. 1 is a perspective view of a container according to the present invention in the form of a plastic bag.

FIG. 1 illustrates a container according to the present invention in the form of a plastic bag 120 having a sealable closure device 121. The bag 120 includes side walls 122 joined at seams 125 to form a compartment sealable by means of the closure device 121.

Figure 3:
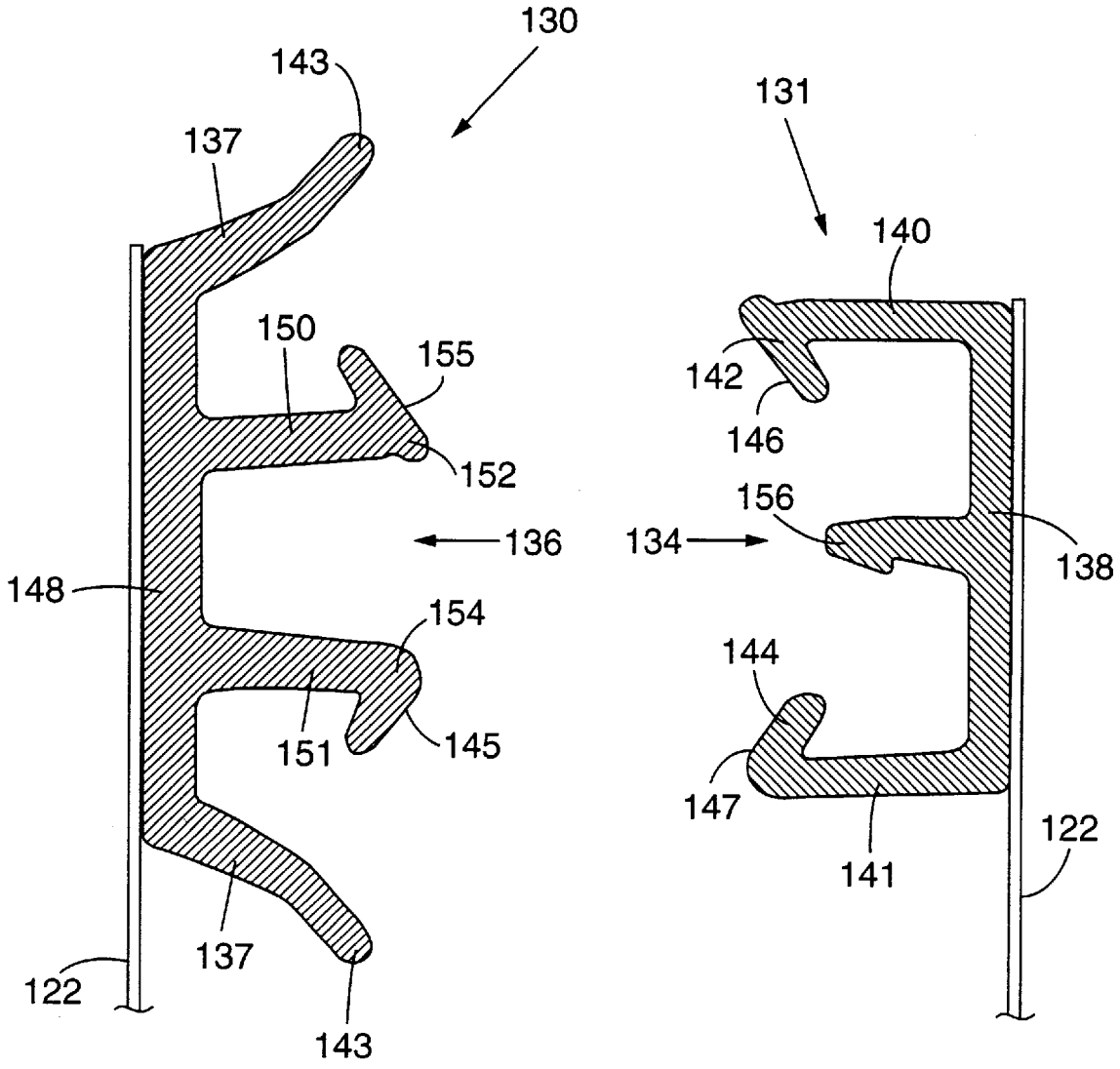
FIG. 3 is an enlarged partial cross-sectional view taken along line 3—3 in FIG. 2.
Figure 7:
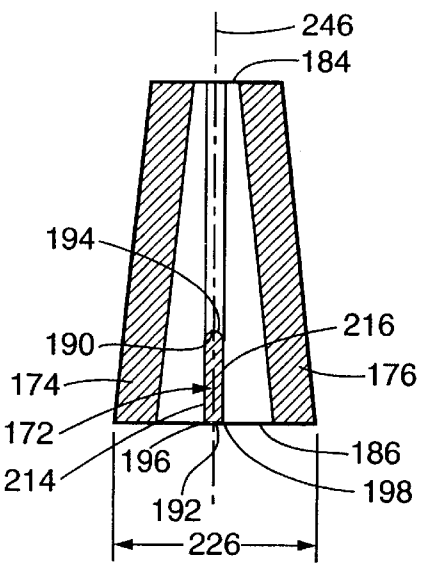
FIG. 7 is a cross-sectional view taken along line 7—7 in FIG. 4.
Figure 4:
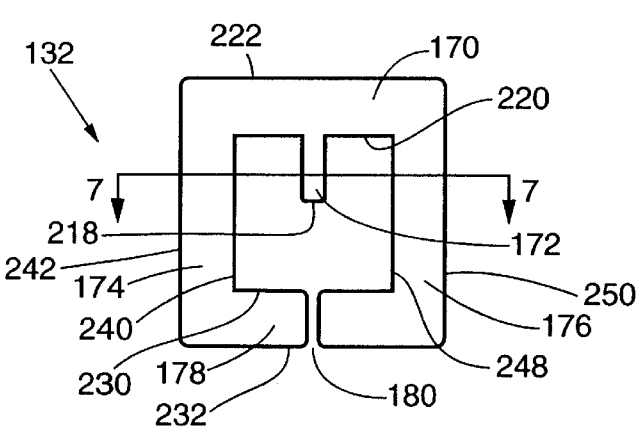
FIG. 4 is a front view of the slider in FIG. 2.
Figure 6:
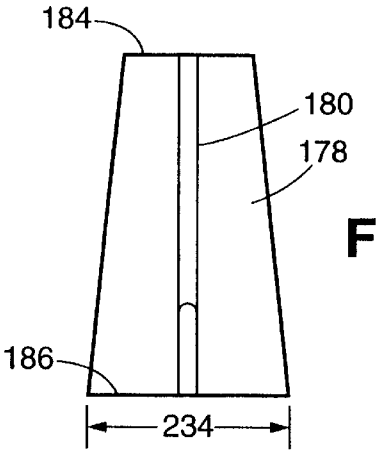
FIG. 6 is a bottom view of the slider in FIG. 2.

The closure device comprises male and female fastening strips 130, 131 and a slider 132. As shown in FIG. 3, the female fastening strip 131 includes a female closure element 134. The male fastening strip 130 comprises a male closure element 136 for engaging the female closure element 134, and further may include a pair of male wings 137 spaced-apart on the male fastening strip on each side of the male closure element 136.

The female closure element 134 may include a base portion 138 and may include a pair of spaced-apart parallely disposed webs 140, 141 extending from the base portion 138. The webs 140, 141 may include female hook closure portions 142, 144 extending from the webs 140, 141 respectively, and facing towards each other. The female hook portions 142, 144 may include guide surfaces 146, 147 which serve to guide the hook portions 142, 144 for occluding with the male hook portions of a mating closure element.

The male closure element 136 may include a base portion and may include a pair of spaced-apart, parallely disposed webs 150, 151 extending from the base portion 148. The webs 150, 151 may include male hook closure portions 152, 154 extending from the webs 150, 151 respectively and facing away from each other. The male hook portions 152, 154 may include guide surfaces 145, 155, which generally serve to guide the hook portions 152, 154 for occlusion with the female hook portions 142, 144 of the mating female closure element. The guide surface 145 may also have a rounded crown surface. In addition, the hook portions may be designed so that the hook portions 144, 154 adjacent the interior of the container provide a greater resistance to opening of the closure device. The male fastening strip may include wings as shown in FIG. 3. The male wings 137 are flexible and extend from the base of the fastening strip. Each wing terminates in an end portion 143 which projects outwardly from the wing 137. The fastening strip may also include a color change enhancement member 156.

Referring to FIGS. 4–7, the slider 132 may include a top portion 170, a separator finger 172, a first side portion 174, a second side portion 176, a bottom portion 178 and a slot 180. The separator finger 172 extends downward from the top portion 170 toward the slot 180. The slider 132 has a first end 184 and a second end 186. 35 The separator finger 172 extends from the second end 186 towards the first end 184. The separator finger has a first end 190 and a second end 192 which correspond with the first end 184 and second end 186 of the slider. The first end 190 has a rounded surface 194 and the second end 192 has two corners or edges 196, 198. The separator finger 172 has a first side portion 214 which corresponds to the first side portion 174, a second side portion 216 which corresponds to the second side portion 176, and a bottom portion 218 which corresponds with bottom portion 178.

The top portion 170 of the slider has an inner surface 220 and an outer surface 222. The width 226 of the top portion 170 tapers and becomes smaller beginning at the second end 186 and moving towards the first end 184.

The bottom portion 178 of the slider has an inner surface 230 and an outer surface 232. The width 234 of the bottom portion 178 tapers and becomes smaller beginning at the second end 186 and moving towards the first end 184.

The first side portion 174 has an inner surface 240 and an outer surface 242. The first side portion 174 is angled inwardly toward the longitudinal axis 246 of the slider beginning at the second end 186 and moving toward the first end 184. The second side portion 176 has an inner surface 248 and an outer surface 250. The second side portion 176 is angled inwardly toward the longitudinal axis 246 of the slider beginning at the second end 186 and moving toward the first end 184.

The bottom portion 178 has a slot 180 which extends from the outer surface 232 to the inner surface 230. In addition, the slot extends from the first end 184 to the second end 186 of the slider. The slot has substantially the same width from the first end 184 to the second end 186 of the slider.

Another embodiment of the slider is shown in FIGS. 4A–7A. This slider is similar to the slider in FIGS. 4–7 except the separator finger has a different shape. Specifically, the slider 132A has a separator finger 172A with a triangular shape. The separator finger 172A has a first end 190A and a second end 192A. The first end 190A has a rounded surface 194A and the second end 192A has two corners or edges 196A, 198A. The second end 192A is wider than the first end 190A.

Figure 7A:
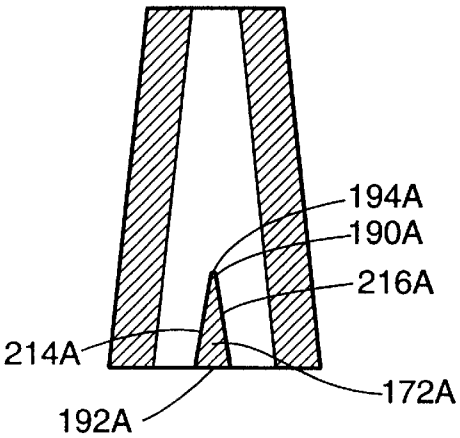
FIG. 7A is a cross-sectional view taken along line 7A—7A in FIG. 4A.
Figure 6A:
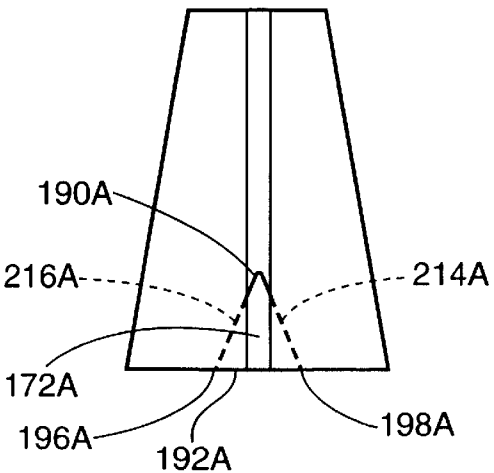
FIG. 6A is a bottom view of the slider in FIG. 4A.

The separator finger 172A has a first side portion 214A and a second side portion 216A. The side portions 214A, 216A taper inward beginning at the second end 192A and moving towards the first end l90A as shown in FIGS. 6A and 7A. The separator finger 172A has a triangular shape as shown in FIG. 6A.

Figure 5:
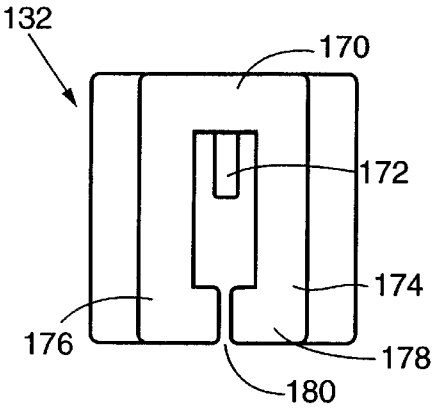
FIG. 5 is a rear view of the slider in FIG. 2.
Figure 5A:
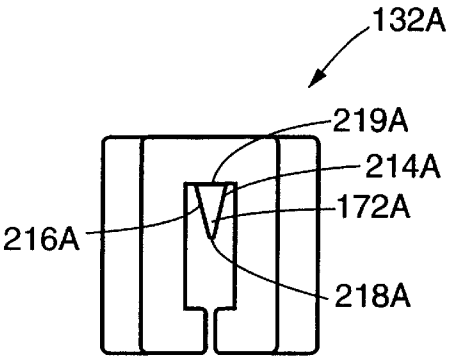
FIG. 5A is a rear view of the slider in FIG. 4A.
Figure 4A:
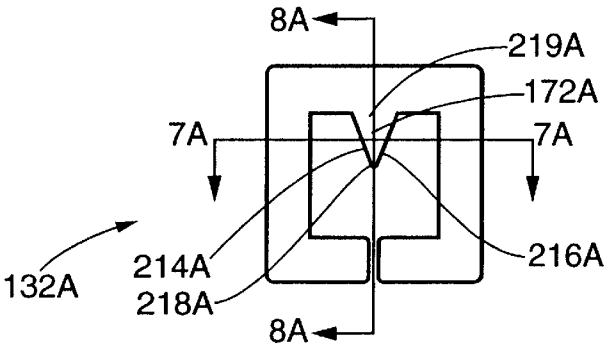
FIG. 4A is a front view of another embodiment of the slider.

Referring to FIGS. 4A and 5A, the separator finger 172A has a bottom portion 218A and a top portion 219A. The top portion 219A is wider than the bottom portion 218A. The first side portion 214A and the second side portion 216A taper inward beginning at the top portion 219A and moving towards the bottom portion 218A as shown in FIGS. 4A and SA. The separator finger 172A has a triangular shape as shown in FIG. 4A.

Figure 8A:
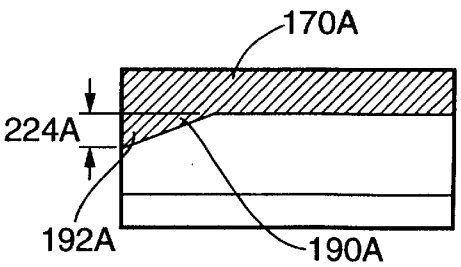
FIG. 8A is a cross-sectional view taken along line 8A—8A in FIG. 4A.

Referring to FIG. 8A, the second end 192A of the separator finger has a height 224A from the top portion 170A.

The first end 190A has a height which may be less than the height of the second end. The separator finger 172A decreases in height 224A along the length of the separator finger from the second end 192A to first end 190A. The separator finger 172A has a triangular shape as shown in FIG. 8A.

In other embodiments, the height, the width, the length and the separation of the sides of the separator finger may be constant or may vary on the separator finger, either individually or in any combination. For example, in one embodiment of the separator finger, the width may be constant but the height decreases. In another embodiment of the separator finger, the height may be constant, but the width decreases.

The slider may be a one piece construction or may include several separate pieces which are assembled in several different ways as shown in U.S. Pat. Nos. 5,007,142, 5,283,937, 5,426,830.

Figure 8:
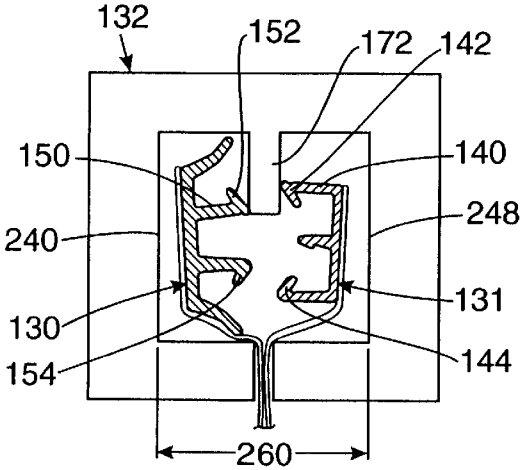
FIG. 8 is an enlarged partial cross-sectional view taken along line 8—8 in FIG. 2.
Figure 11:
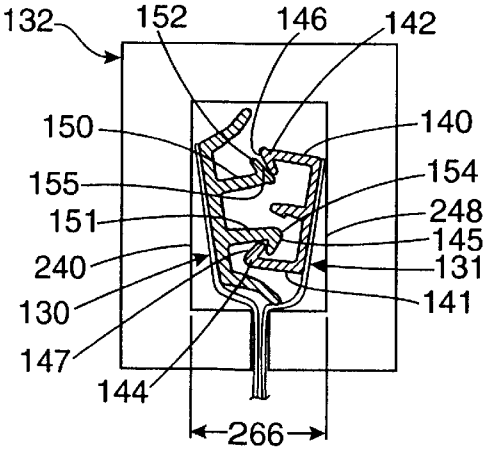
FIG. 11 is an enlarged partial cross-sectional view taken along line 11—11 in FIG. 2.
Figure 12:
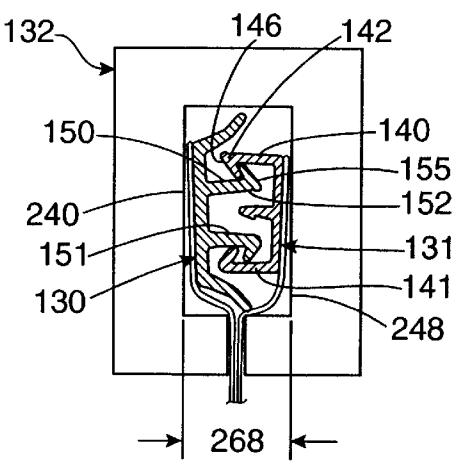
FIG. 12 is an enlarged partial cross-sectional view taken along line 12—12 in FIG. 2.
Figure 13:
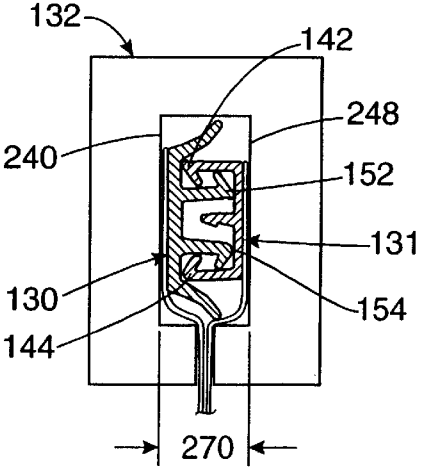
FIG. 13 is an enlarged partial cross-sectional view taken along line 13—13 in FIG. 2.

FIGS. 8–13 illustrate occlusion and deocclusion of the closure device. When FIGS. 8–13 are viewed in numerical sequence, FIGS. 8-13 illustrate occlusion of the fastening strips. When FIGS. 8–13 are viewed in reverse numerical sequence (i.e. viewed from FIG. 13 backwards to FIG. 8), FIGS. 13–8 illustrate deocclusion of the fastening strips.

Figure 2:
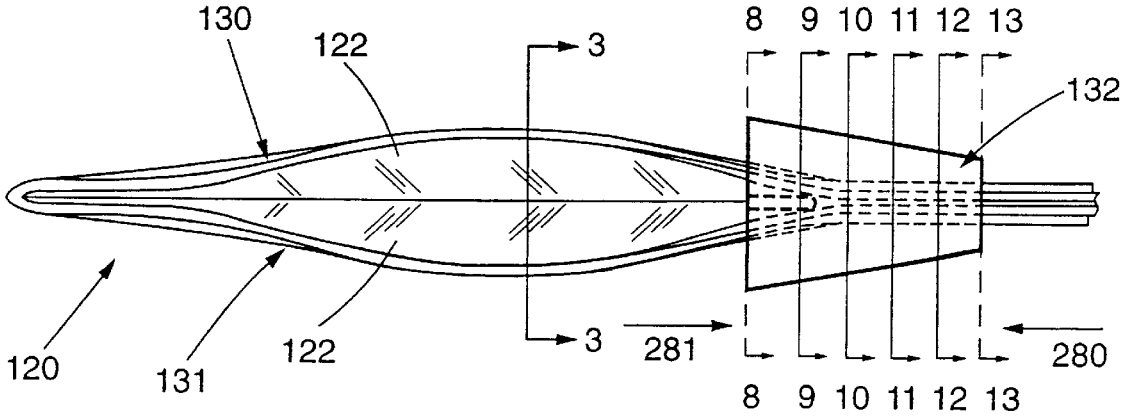
FIG. 2 is an enlarged partial top view of the container in FIG. 1.

The occlusion of the fastening strips will be described and then the deocclusion of the fastening strips will be described. The slider 132 facilitates the occlusion of the fastening strips 130, 131 by moving the fastening strips towards each other and causing the closure portions to engage. The closure portions engage in a sequential fashion with the inner closure portions 144, 145 engaging first and then the outer closure portions 142, 152 engaging second. Referring to FIG. 2, the slider 132 is moved in the occlusion direction 280 and the fastening strips 130, 131 enter the slider 132 as shown in FIG. 8. Referring to FIG. 8, the fastening strips 130, 131 are deoccluded and the separator finger 172 is positioned between closure portions 142, 152. The inner surface 240 of the first side portion and the inner surface 248 of the second side portion are separated by a width 260.

Figure 9:
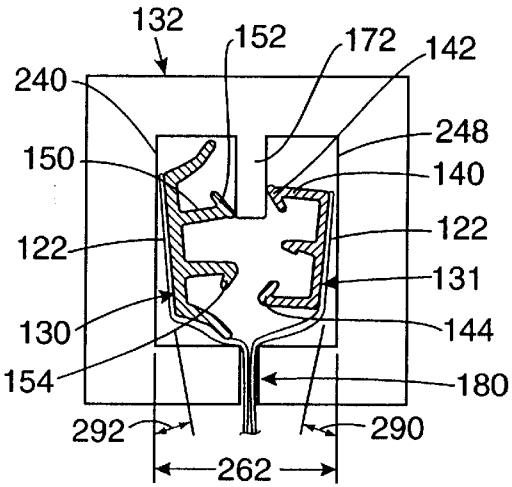
FIG. 9 is an enlarged partial cross-sectional view taken along line 9—9 in FIG. 2.

As the slider is moved further along the fastening strips in the occlusion direction 280 as shown in FIG. 2, the slider causes the fastening strips to move closer together as shown in FIG. 9. Referring to FIG. 9, the fastening strips 130, 131 are deoccluded and the separator finger 172 is positioned between closure portions 142, 152. However, the inner surface 240 and the inner surface 248 are closer together than in FIG. 8 and are separated by a width 262 which is less than width 260 in FIG. 8. The inner surfaces 240, 248 are beginning to engage the side walls 122 and thus the fastening strips 130, 131.

Figure 10:
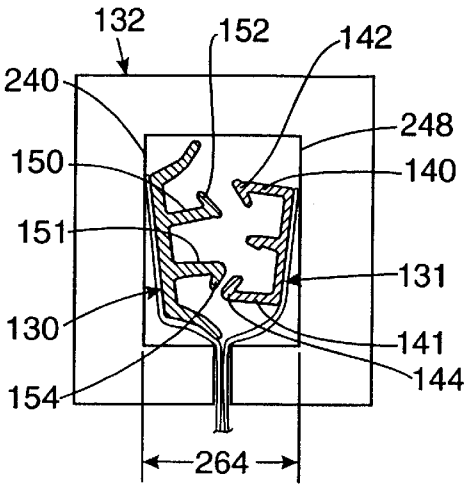
FIG. 10 is an enlarged partial cross-sectional view taken along line 10—10 in FIG. 2.

As the slider continues to move along the fastening strips in the occlusion direction 280 as shown in FIG. 2, the slider continues to cause the fastening strips to move closer together as shown in FIG. 10. Referring to FIG. 10, the fastening strips 130, 131 are deoccluded but the separator finger 172 is not between the closure portions 142, 152. The fastening strips are deoccluded because the fastening strips are continuous and the deoccluded portions of the fastening strips in FIGS. 8 and 9 are acting upon the portions of the fastening strips in FIG. 10. In fact, with respect to FIGS. 8–13, the positions of the fastening strips are effected not only by the forces acting upon them by the slider at that location but are also effected by the position of the fastening strips at locations before and after that location. For example, the positions of the fastening strips in FIG. 9 are effected by the positions of the fastening strips in FIGS. 8 and 10.

The amount of effect that the position of fastening strips from one location has upon the position of the fastening strips in another location depends upon several factors, such as, the structure of the fastening strips and the material from which the fastening strips are made. For example, if the base of the fastening strips are relatively thick, then the effect at other locations would be greater than if the base was relatively thin. As another example, if the material for the fastening strips is relatively rigid, then the effect at other locations would be greater than if the material was relatively flexible.

Returning to FIG. 10, the inner surface 240 and the inner surface 248 are closer together than in FIG. 9 and are separated by a width 264 which is less than width 262 in FIG. 9. The inner surfaces 240, 248 are engaging the sidewalls 122 and thus the fastening strips 130, 131. The inner surfaces 240, 248 are applying forces to the fastening strips which causes the fastening strips to move closer together. The inner closure portions 144, 154 are closer to each other than the outer closure portions 142, 152 due to the separating action of the separator finger 172 as shown in FIGS. 8 and 9.

As the slider continues to move along the fastening strips in the occlusion direction 280 as shown in FIG. 2, the slider continues to cause the fastening strips to move closer together as shown in FIG. 11. Referring to FIG. 11, the inner closure portions 144, 154 have occluded. More specifically, the male hook portion 154 has engaged the female hook closure portion 144. As the slider applies forces to the fastening strips, the female web 141 deflects outwardly and the male web 151 deflects inwardly in order to allow the female hook portion 144 and the male hook portion 154 to pass each other. In addition, the hook closure portions may also deflect during this process. The guide surfaces 145, 147 serve to guide the hook portion 154 for occluding with hook portion 144. As the slider 132 continues to apply forces, the female hook portion 144 engages the male hook portion 154 as shown in FIG. 11. Similarly, the outer closure portions 142, 152 occlude as the guide surfaces 146, 155 and the hook portions 142, 152 engage each other as shown in FIGS. 11 and 12.

As shown in FIG. 11, the inner surfaces 240, 248 are closer together than in FIG. 10 and are separated by a width 266 which is less than width 264 in FIG. 10. The inner surfaces 240, 248 are engaging the sidewalls 122 and thus the fastening strips 130, 131. The inner surfaces 240, 248 are applying forces to the fastening strips which causes the fastening strips to move closer together.

As the slider continues to move along the fastening strips in the occlusion direction, the slider continues to cause the fastening strips to move closer together as shown in FIG. 12. Referring to FIG. 12, the fastening strips 130, 131 are occluded. Specifically, the inner closure portions 144, 154 and the outer closure portions 142, 152 are occluded. The guide surfaces 146, 155 and the hook portions 142, 152 engaged each other as noted above. The inner surfaces 240, 248 are closer together in FIG. 12 as compared to FIG. 11 and are separated by a width 268 which is less than width 266 in FIG. 11. The inner surfaces 240, 248 apply forces to the fastening strips which causes the fastening strips to move closer together.

As shown in FIG. 13, the fastening strips 130, 131 are occluded prior to exiting the slider. The inner surfaces 240, 248 are closer together in FIG. 13 as compared to FIG. 12 and the inner surfaces 240, 248 are separated by a width 270 which is less than width 268 in FIG. 12. The inner surfaces 240, 248 apply forces to the fastening strips which causes the fastening strips to move closer together. As shown in FIG. 13, the fastening strips 130, 131 are moved toward each other so that a space is temporarily created between the hook closure portions 142, 144, 152, 154 to assure that the hook closure portions have fully engaged. After the fastening strips exit the slider, the fastening strips will return to positions relative to each other similar to FIG. 12.

The slider 132 facilitates the deocclusion of the fastening strips 130, 131 by moving the fastening strips away from each other and causing the webs to disengage. The webs disengage in a sequential fashion with the outer webs 140, 150 disengaging first and then the inner webs 141, 151 disengaging second.

The deocclusion of the fastening strips 130, 131 in FIGS. 8–13 would occur in the reverse order of these figures. Thus, deocclusion is illustrated by beginning at FIG. 13 and moving in reverse order toward FIG. 8. Referring to FIG. 2, the slider 132 is moved in the deocclusion direction 281 and the fastening strips 130, 131 enter the slider 132 as shown in FIG. 13. Referring to FIG. 13, the fastening strips 130, 131 are occluded as they enter the slider 132. The inner surfaces 240, 248 are separated by a width 270.

As the slider continues to move along the fastening strips in the deocclusion direction 281, the slider causes the fastening strips to move away from each other as shown in FIG. 12. Referring to FIG. 12, the inner surfaces 240, 248 are separated by a width 268 which is greater than the width 270 in FIG. 13. As noted above, the positions of the fastening strips are effected not only by the forces acting upon them by the slider at that specific location, but are also effected by the position of the fastening strips at locations before and after that specific location. In this case, the fastening strips 130, 131 are being urged against the inner surfaces 240, 248 due to the separating action of the separating finger 172 as shown in FIGS. 8–9.

As the slider continues to move along the fastening strips in the deocclusion direction 281 as shown in FIG. 2, the slider continues to cause the fastening strips to move away from each other as shown in FIG. 11. Referring to FIG. 11, the inner surfaces 240, 248 are separated by a width 266 which is greater than the width 268 in FIG. 12. The outer closure portions 142, 152 have deoccluded. The outer closure portions deocclude due to the separating action of the separating finger 172 as shown in FIGS. 9 and 10 and because the width 266 of the inner surfaces 240, 248 allows the fastening strips 130, 131 to move further apart and thus permit the outer closure portions 142, 152 to deocclude.

Referring to FIG. 10, the inner surfaces 240, 248 are separated by a width 264 which is greater than the width 266 in FIG. 11. The inner closure portions have deoccluded. The inner closure portions 144, 154 deocclude due to the separating action of the separating finger 172 as shown in FIGS. 9 and 10 and because the width 264 of the inner surfaces 240, 248 allows the fastening strips 130, 131 to move further apart and thus permit the inner closure portions 144, 154 to deocclude.

Referring to FIG. 9, the inner surfaces 240, 248 are separated by a width 262 which is greater than the width 264 in FIG. 10. In addition, as shown in FIGS. 2 and 9, the separator finger 172 engages the outer closure portions 142, 152 and causes the outer closure portions to separate and move outward towards the inner surfaces 240, 248. The separator finger 172 has a rounded surface 194 which facilitates the engagement between the separator finger 172 and the outer closure portions 142, 152. The fastening strips 130, 131 move outwards until the inner surfaces 240, 248 resist any further outward movement.

As the slider is moved further along the fastening strips, the slider permits further separation or deocclusion of the fastening strips. Referring to FIG. 8, the inner surfaces 240, 248 are separated by a width 260 which is greater than the width 262 in FIG. 9. The fastening strips 130, 131 move outwards until the inner surfaces 240, 248 would resist any further outward movement. As shown in FIGS. 2 and 8, the inner closure portions 144, 154 and the outer closure portions 142, 152 of the fastening strips 130, 131 are deoccluded when the fastening strips exit the slider 132.

In summary, the invention provides two fastening strips and a slider with a separator finger wherein the separator finger extends into the closure elements without extending completely through the closure elements. More specifically, the first closure element includes a first closure portion and a second closure portion and the second closure element includes a third closure portion and a fourth closure portion. The first closure portion engages the third closure portion and the second closure portion engages the fourth closure portion. The separator finger extends between the first and third closure portions but not between the second and fourth closure portions.

Figure 14:
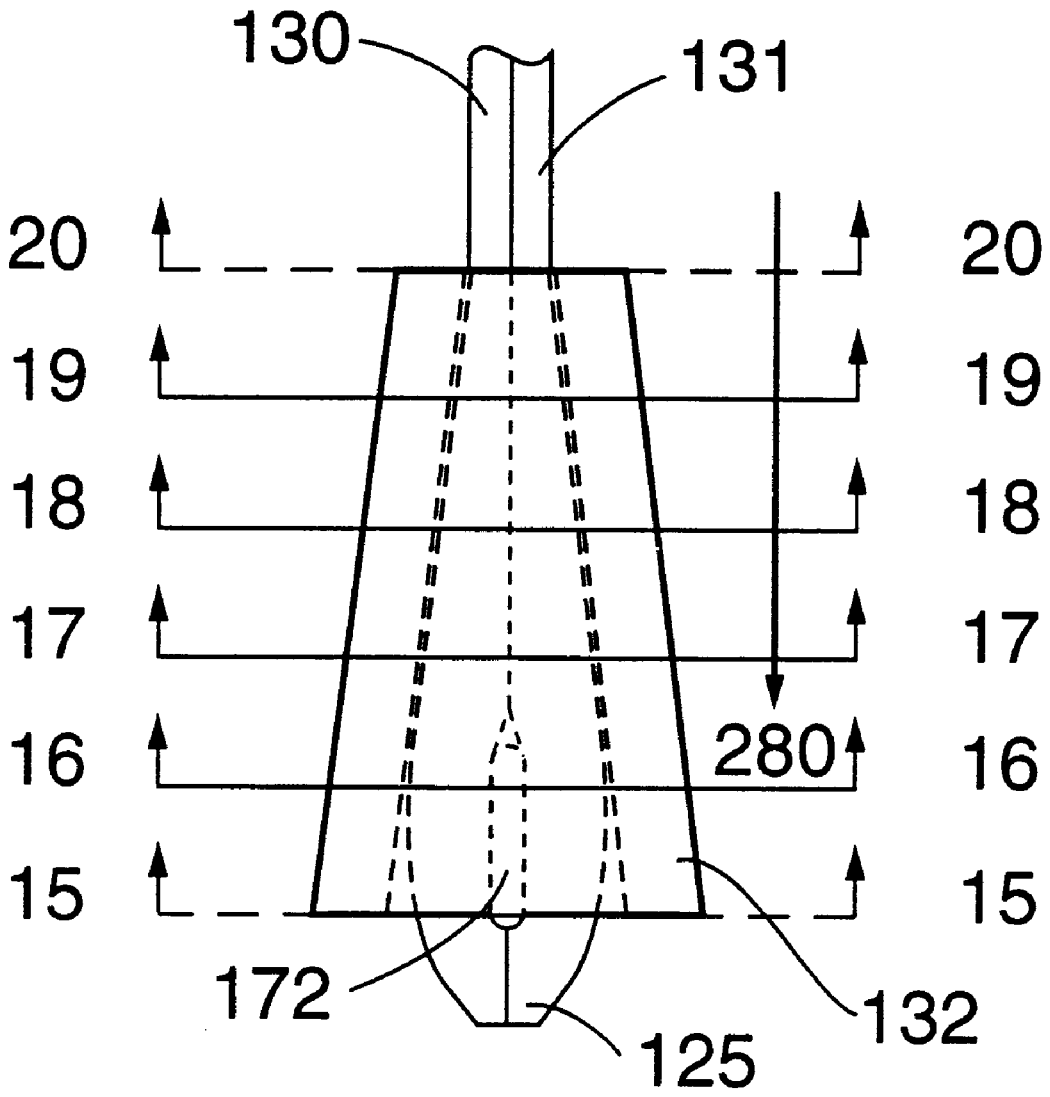
FIG. 14 is an enlarged partial top view of the container shown in FIG. 1 with the slider in the end position and the fastening strips in the occluded position.

FIG. 14 shows the slider 132 in the end position of the fastening strips 130, 131 near the seam 125. FIGS. 15–20 illustrate occlusion of the fastening strips in the end position. In accordance with one feature of the invention, these figures demonstrate that the closure device will have a leak proof seal when the slider is in the end position. The leak proof seal is created even though the separator finger extends between the outer closure portions.

Referring to FIGS. 15–20, the occlusion and deocclusion of the outer closure portions 142, 152 is substantially similar to the occlusion and deocclusion of the outer closure portions in FIGS. 8–13. Furthermore, the movement of the inner closure portions 144, 154 in FIGS. 18–20 would be substantially the same as the movement of the inner closure portions 144, 154 in FIGS. 11–13.

Figure 17:
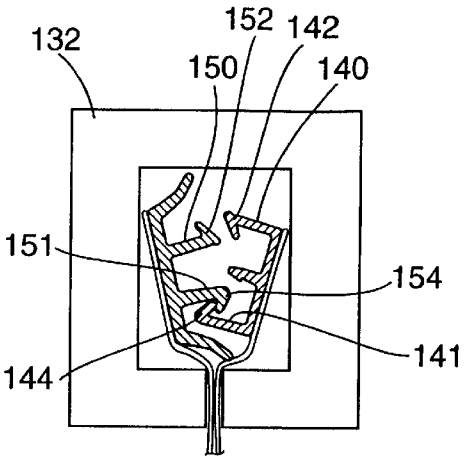
FIG. 17 is an enlarged cross sectional view taken along line 17—17 in FIG. 14.
Figure 16:
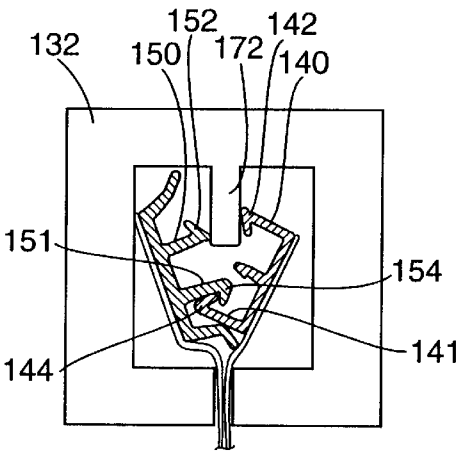
FIG. 16 is an enlarged cross sectional view taken along line 16—16 in FIG. 14.
Figure 15:
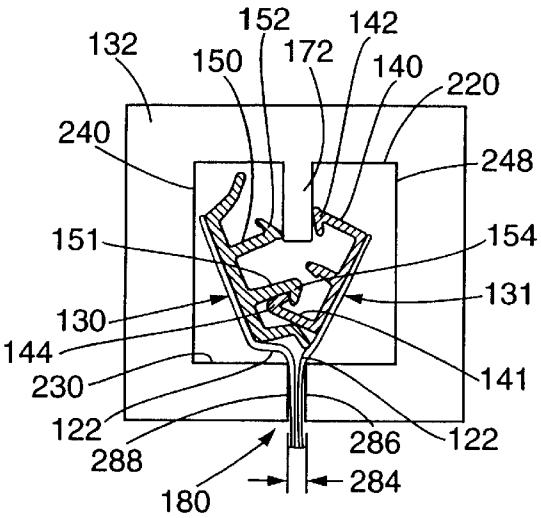
FIG. 15 is an enlarged cross sectional view taken along line 15—15 in FIG. 14.
Figure 20:
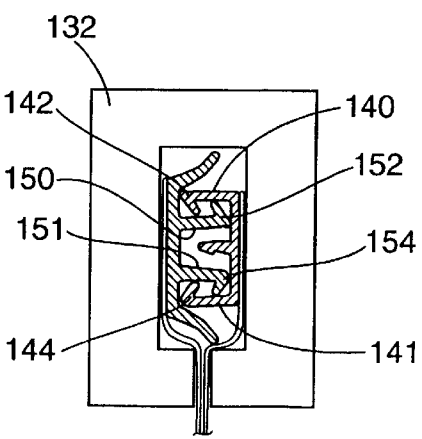
FIG. 20 is an enlarged cross sectional view taken along line 20—20 in FIG. 14.
Figure 19:
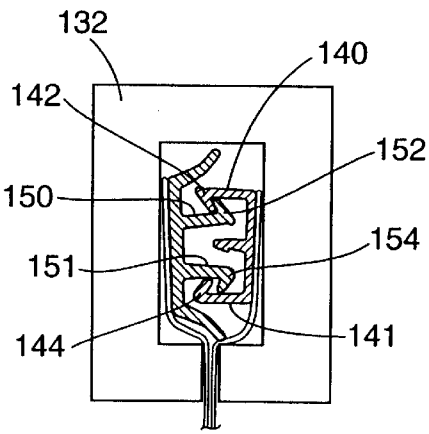
FIG. 19 is an enlarged cross sectional view taken along line 19—19 in FIG. 14.
Figure 18:
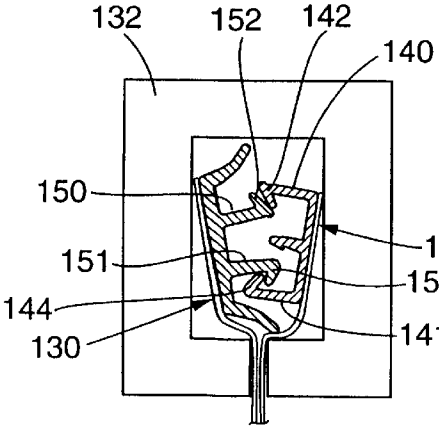
FIG. 18 is an enlarged cross sectional view taken along line 18—18 in FIG. 14.

However, the movement of the inner closure portions 144, 154 in FIGS. 15–17 is different than the movement of the inner closure portions 144, 154 in FIGS. 8–10. As noted above, the positions of the fastening strips are effected not only by the forces acting upon them by the slider at that location but are also effected by the position of the fastening strips at locations before and after that location. Specifically, with respect to the position of the inner closure portions 144, 154 in FIGS. 15–17, the position of the inner closure portions 144, 154 is effected by the seam 125 at the end of the fastening strips. At the seam 125, the fastening strips 130, 131 are melted together which effectively occludes the fastening strips. This occlusion of the fastening strips 130, 131 at the seam 125 prevents separating action of the separator finger 172 from deoccluding the inner closure portions 144, 154. Thus, the inner closure portions 144, 154 remain occluded even though the separator finger 172 is attempting to deocclude the inner closure portions. Consequently, the inner closure portions 144, 154 remain occluded through the length of the fastening strips and establish a leak proof seal through the length of the fastening strips when fully occluded.

For example, as the user moves the slider 132 in the occlusion direction 280 as shown in FIG. 14, the slider would occlude the fastening strips 130, 131 in the sequence shown in FIGS. 15–20. When the slider is in the locations shown in FIGS. 15–17, the inner closure portions 144, 154 of the fastening strips would usually be deoccluded as shown in FIGS. 8–10. In addition, the slider is prevented from further movement in the occlusion direction 280 when the separator finger 172 contacts the seam 125 as shown in FIG. 14. However, as noted above, the seam 125 causes the inner closure portions 144, 154 to be occluded at the locations in FIGS. 15–17 even when the slider is not present. Therefore, when the slider moves to the locations shown in FIGS. 15–17, the inner closure portions 144, 154 are already occluded and the separating action of the separating finger 172 is not able to overcome the occlusion effect of the seam 125. Thus, the inner closure portions 144, 154 remain occluded through the length of the fastening strips and establish a leak proof seal.

Another feature of the invention is that the slider may also provide an additional seal. Referring to FIGS. 4–6 and 15–20, the slider 132 includes a slot 180 at the bottom of the slider and which extends along the length of the slider. As shown in FIG. 15 the sidewalls 122 of the bag extend from the fastening strips 130, 131 and downward through the slot 180. The slot 180 includes a first face 286 and a second face 288 which are separated by a width 284. The width 284 is small enough to cause a seal between the sidewalls 122 near the location of the faces 286, 288 and large enough to allow the slider to move along the sidewalls 122 without making the slider too difficult to move. Thus, the slot 180 provides an additional seal along the length of the slider.

The fastening strips may also achieve a position at any angle to the vertical when the fastening strips are within the slider. Specifically, referring to FIG. 9, the fastening strips 130, 131 are at angles 290, 292 to the vertical plane. The fastening strips are at an angle for several reasons. First, the separator finger 172 is acting upon the outer closure portions 142, 152 to separate the closure portions. Second, the slot 180 is acting upon the sidewalls 122 and pulling the sidewalls 122 and the fastening strips 130, 131 toward the slot 180. Third, the occlusion of the inner closure portions 144, 154 at the location in FIG. 11 is effecting the position of the fastening strips 130, 131 at the locations in FIGS. 8, 9 and 10. Thus, the fastening strips 130, 131 are at an angle to the vertical. In another embodiment, the inner surfaces 240, 248 could be positioned on an angle to substantially match the angle of the fastening strips at various locations within the slider.

The slider is attached to the fastening strips so that the slider may move in the longitudinal X axis but not in the transverse Y axis and not in the vertical Z axis. Specifically, the slot 180 and the bottom portion 178 form shoulders which assist in retaining the slider 132 on the fastening strips 130, 131. Referring to FIG. 15, the inner surfaces 220, 230, 240, 248 enclose the fastening strips 130, 131. Furthermore, the width 284 of the slot 180 does not permit the passage of the fastening strips 130, 131. Therefore, a user should not be able to remove the slider 132 from the fastening strips 130, 131 by pulling in an upward direction with respect to FIG. 15. In addition, the sidewalls 122 and/or the fastening strips 130, 131 engage the inner surfaces 220, 230, 240, 248 and act as guides for the sliding movement of the slider 132 along the fastening strips.

Another feature of the invention is that the slider may be used without an additional end stop on the fastening strips. As noted above and as shown in FIG. 14, the slider is prevented from further movement in the occlusion direction 280 when the separator finger 172 contacts the seam. Therefore, the slider may be used without an additional end stop on the end of the fastening strips. However, the slider may be used with additional end stops, such as, the end stops shown in U.S. Pat. Nos. 5,067,208, 5,088,971, 5,131,121, 5,161,286, 5,189,764, 5,405,478, 5,442,837, 5,448,807, 5,482,375, which are incorporated herein by reference.

The fastening strips and/or the slider may also include a structure to provide a home or parking position for the slider at the end of the fastening strips, such as, the structure shown in U.S. Pat. Nos. 5,067,208, 5,189,764, 5,301,394 and 5,301,395 which are incorporated herein by reference.

The fastening strips and/or the sidewalls of the bag may also include flanges to allow the user to open the bag more easily and insert items in the bag. The flanges would extend above the webs and/or wings and the slider would be increased in height to accommodate the flanges.

The fastening strips and the slider may also include a structure to accommodate the separator finger at the end of the fastening strips, such as, the slits, notches and other means as shown in U.S. Pat. Nos. 5,020,194, 5,067,208, 5,088,971, 5,131,121, 5,161,286, 5,301,394, 5,301,395 and 5,442,837, which are incorporated herein by reference. The structure may accommodate the separator finger and thus allow the outer closure portions 142, 152 to occlude near the end of the fastening strips.

Figure 21:
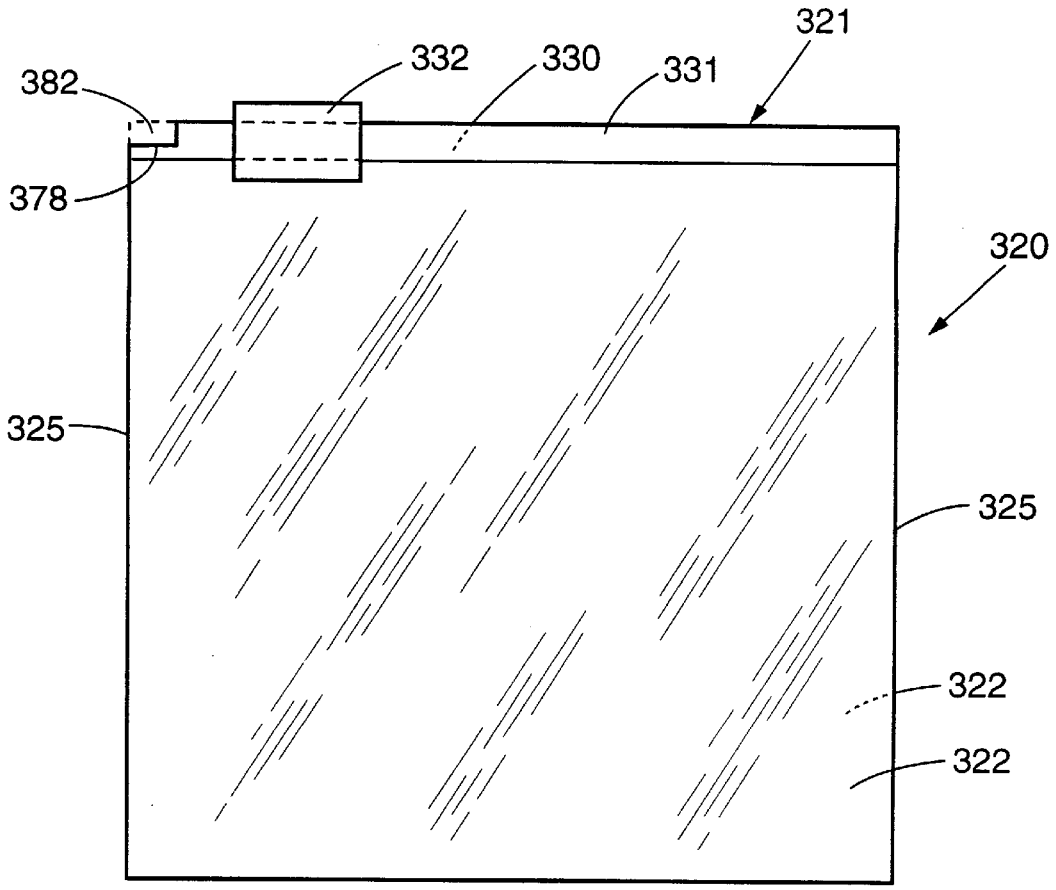
FIG. 21 is a front view of another embodiment of the closure device according to this invention showing a notch in the fastening strips.
Figure 22:
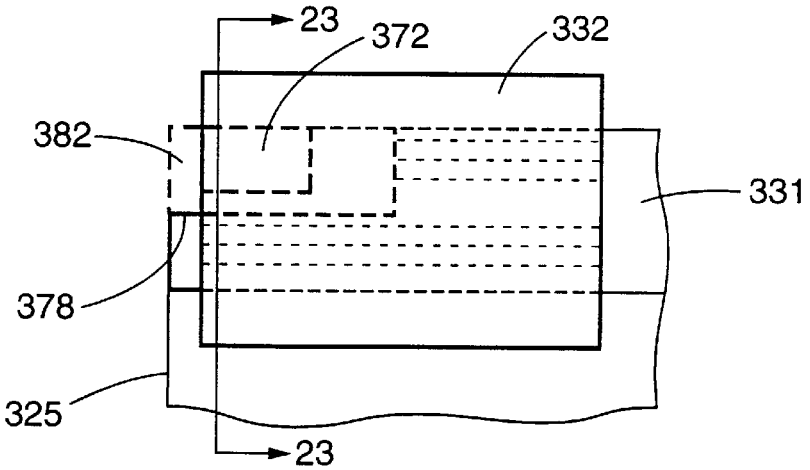
FIG. 22 is a partial front view of the closure device in FIG. 21.
Figure 23:
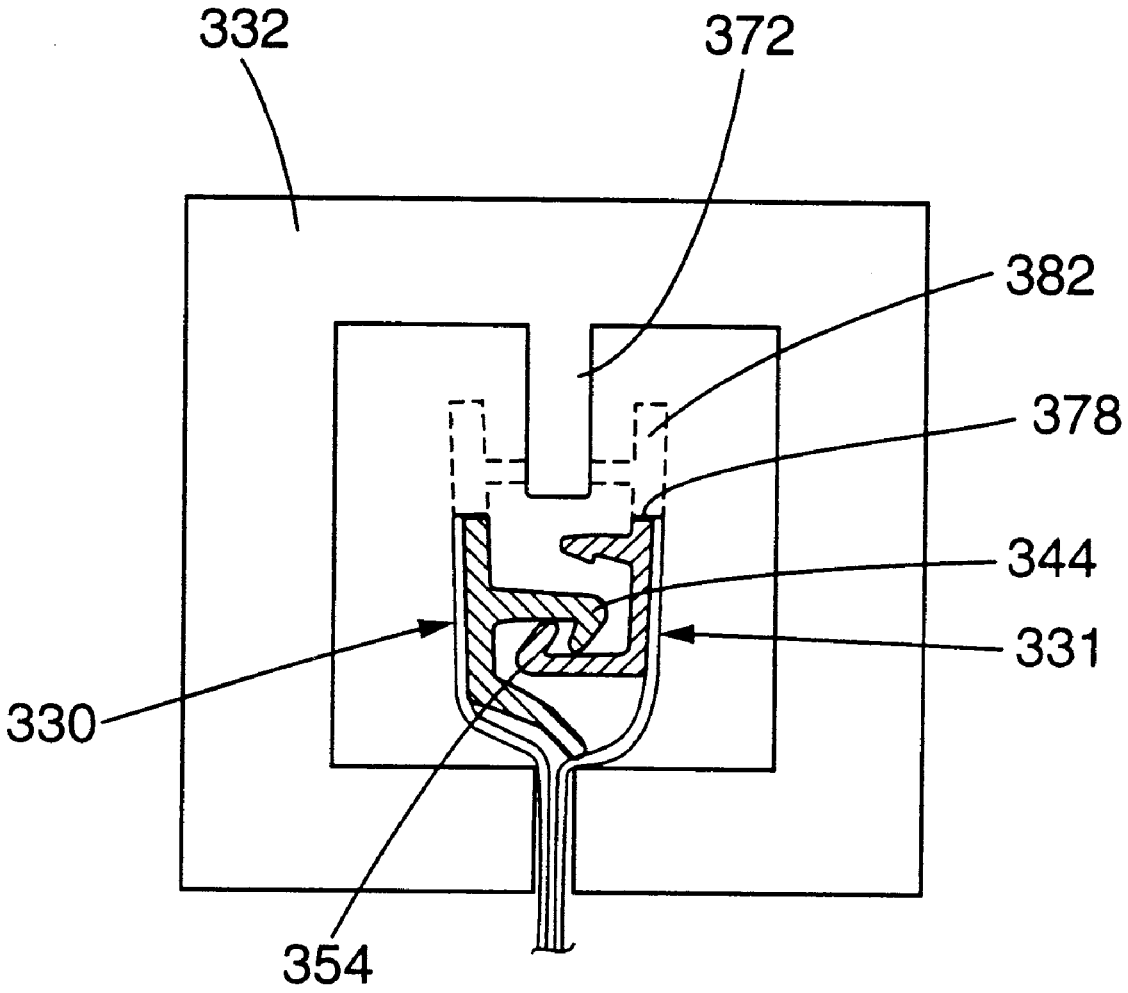
FIG. 23 is a cross-sectional view taken along the line 23—23 in FIG. 22.

For example, FIGS. 21–23 illustrate another embodiment wherein the fastening strips have a notch near the seam. Referring to FIG. 21, the bag 320 has a closure device 321. In addition, the bag 320 includes side walls 322 joined at seams 325 to form a compartment sealable by means of the closure device 321. Referring to FIGS. 21–23, the closure device 321 includes first and second fastening strips 330, 331 and a slider 332. The fastening strips have a notch 378 near the seam 325. As shown by dashed lines, the notch removes a portion 382 of the fastening strips 330, 331 to accommodate the separator finger 372. The notch 378 permits the closure portions 344, 354 and thus, the fastening strips to occlude in the end position.

Figure 24:
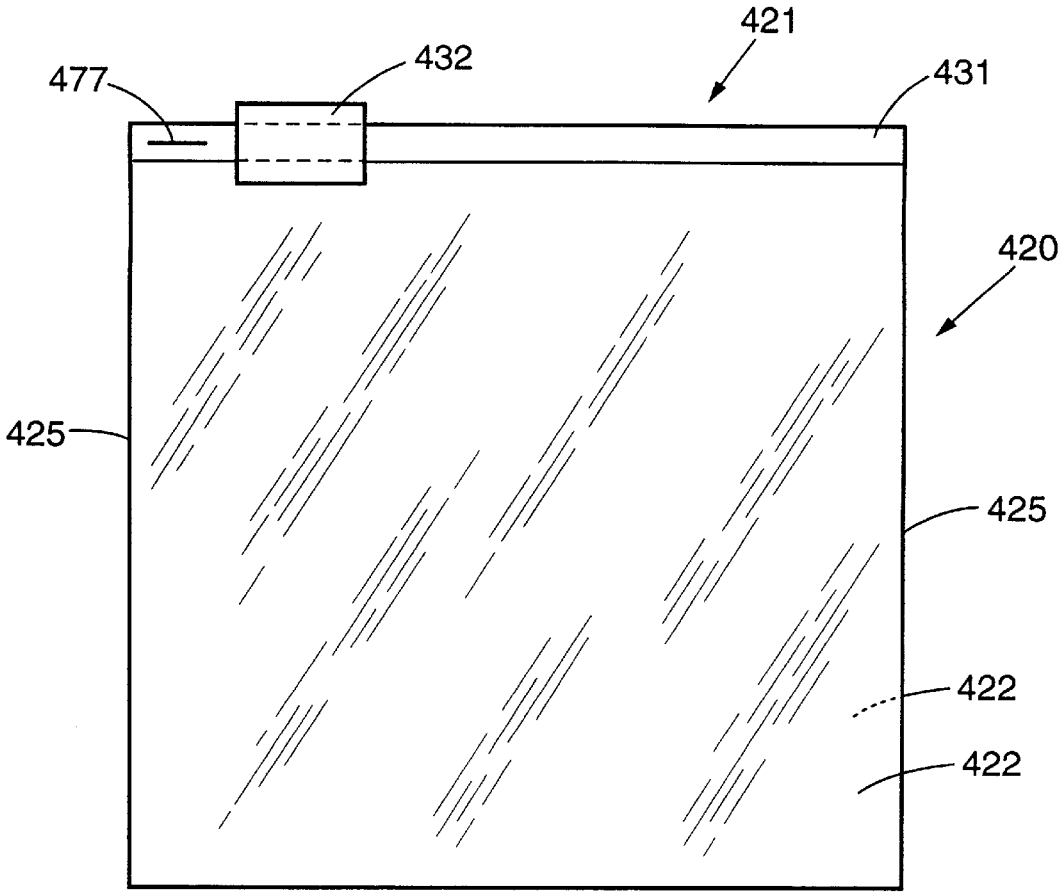
FIG. 24 is a front view of another embodiment of the closure device according to this invention showing a slit in the fastening strips.
Figure 25:
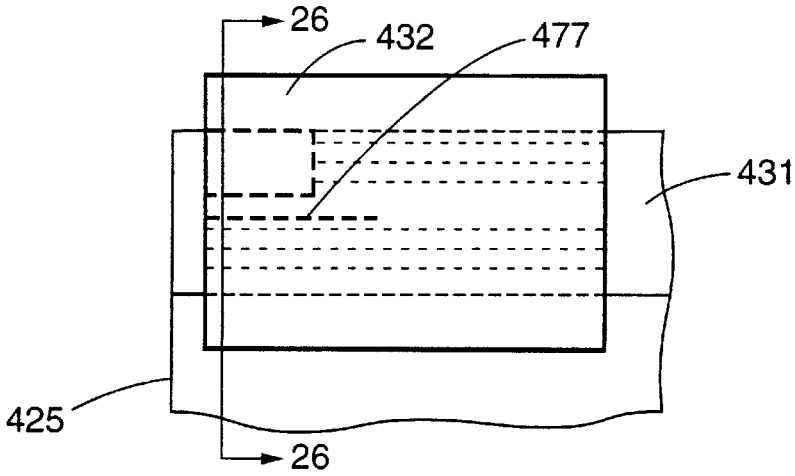
FIG. 25 is a partial front view of the closure device in FIG. 24.
Figure 26:
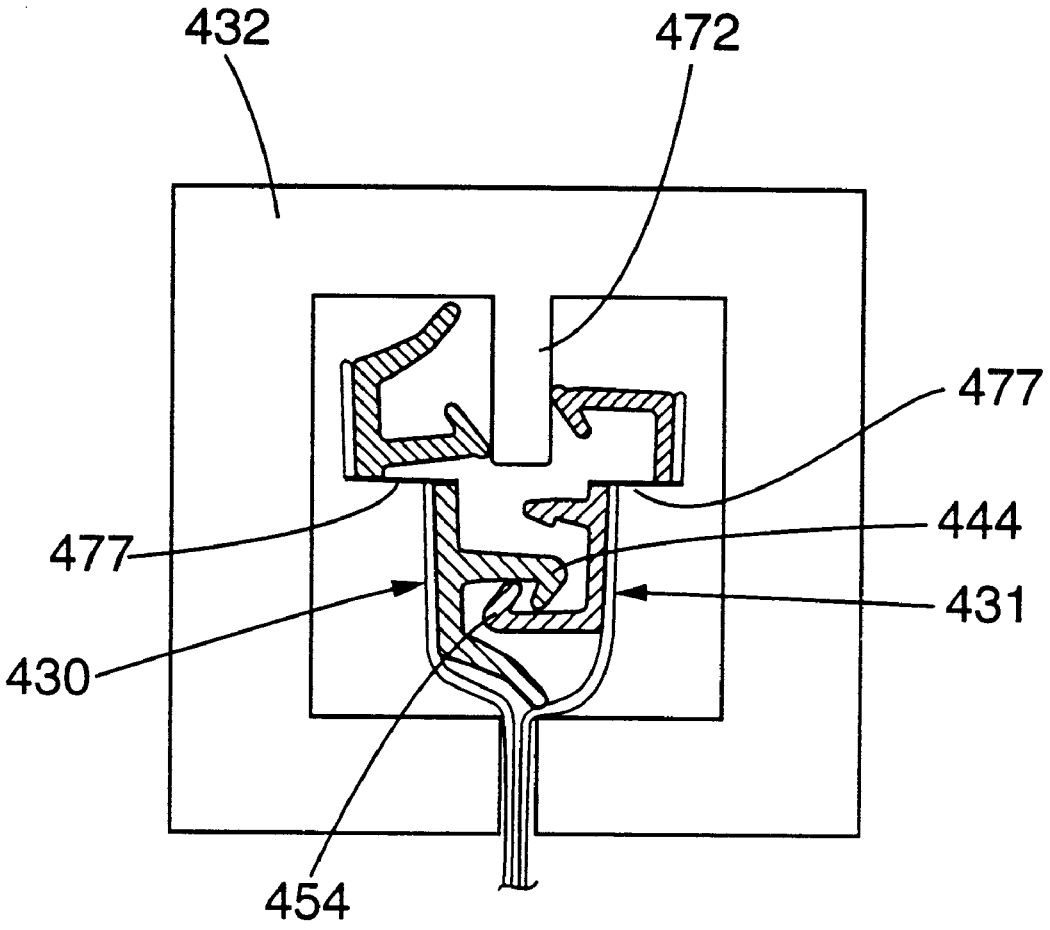
FIG. 26 is a cross-sectional view taken along the line 26—26 in FIG. 25.

As another example, FIGS. 24-26 illustrate another embodiment wherein the fastening strips have a slit near the seam. Referring to FIG. 24, the bag 420 has a closure device 421. In addition, the bag 420 includes side walls 422 joined at seams 425 to form a compartment sealable by means of the closure device 421. Referring to FIGS. 24–26, the closure device 421 includes first and second fastening strips 430, 431 and a slider 432. The fastening strips have a slit 477 near the seam 425. As shown in FIG. 26, the slit 477 allows the fastening strips 430, 431 to accommodate the separator finger 472. The slit 477 permits the closure portions 444, 454 and thus, the fastening strips to occlude in the end position.

Figure 28:
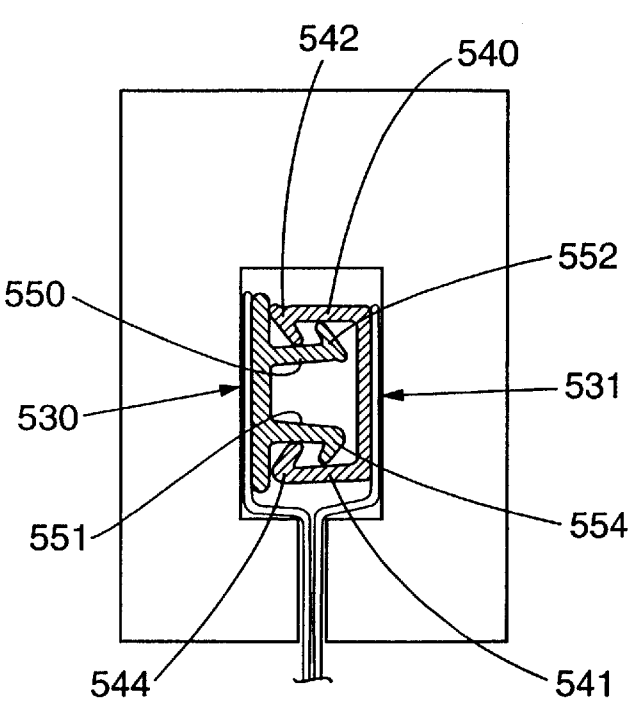
FIG. 28 is a cross-sectional view of the closure device in FIG. 27 in an occluded position.
Figure 27:
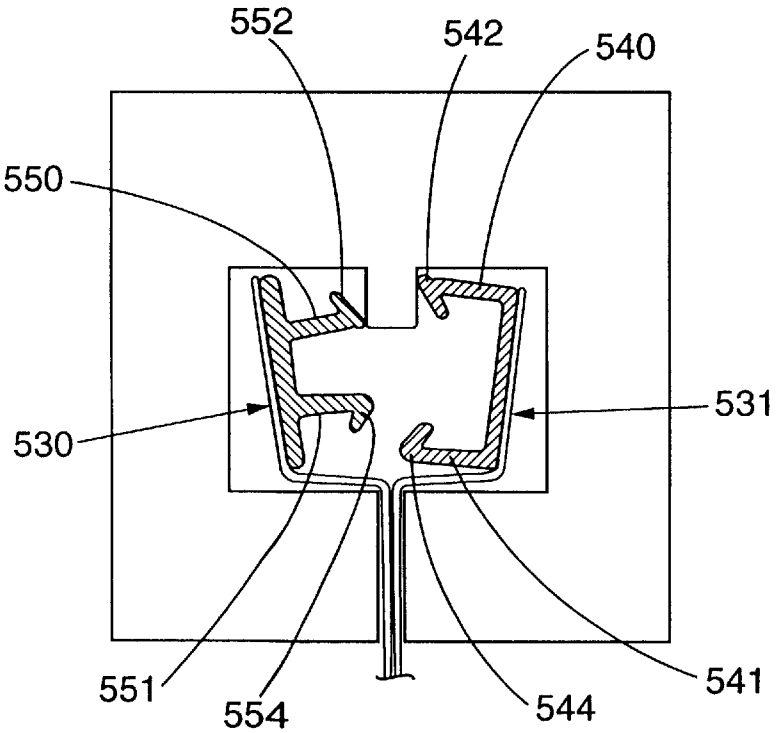
FIG. 27 is a cross-sectional view of another embodiment of the closure device according to this invention in a deoccluded position.

FIGS. 27 and 28 illustrate another embodiment of the closure device of the present invention. Referring to FIGS. 27–28, the fastening strips 530, 531 are similar to fastening strips 130, 131 except the fastening strips 530, 531 do not include the wings 137 and the color change enhancement member 156. The remaining components of the fastening strips 530, 531, such as the webs 540, 541, 550, 551 and the closure portions 540, 544, 552, 554 are similar to the components in fastening strips 130, 131. FIG. 27 shows the fastening strips 530, 531 in a deoccluded position and FIG. 28 shows the fastening strips 530, 531 in a occluded position. The occlusion and deocclusion of the fastening strips 530, 531 is similar to the occlusion and deocclusion of the fastening strips 130, 131 noted above.

Figure 30:
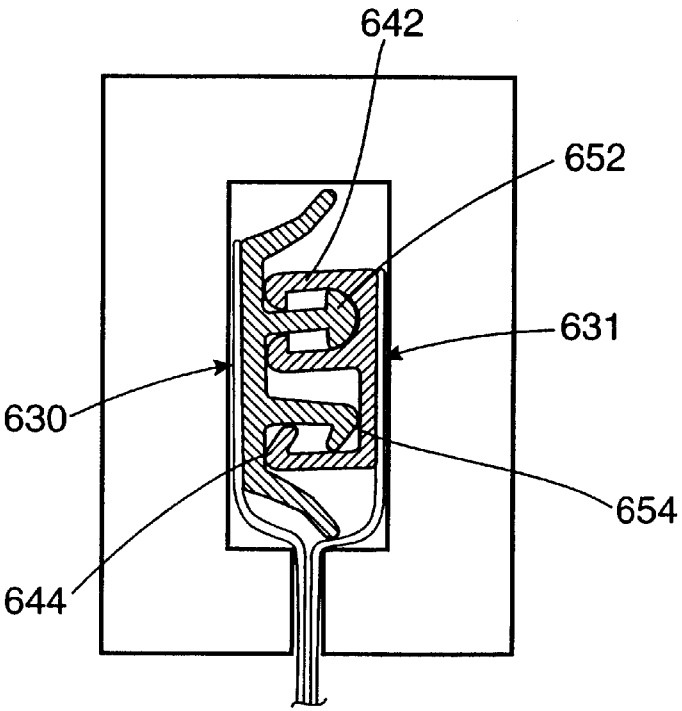
FIG. 30 is a cross-sectional view of the closure device in FIG. 29 in an occluded position.
Figure 29:
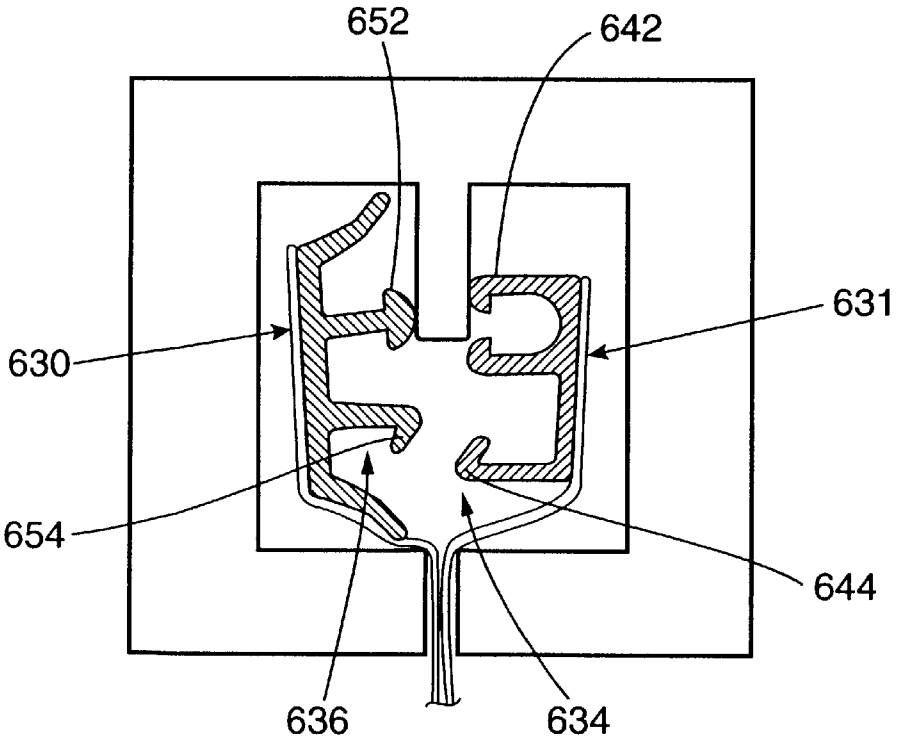
FIG. 29 is a cross-sectional view of another embodiment of the closure device according to this invention in a deoccluded position.

FIGS. 29 and 30 illustrate another embodiment of the closure device of the present invention. In this embodiment, the closure device includes another type of closure elements. Referring to FIG. 29, the fastening strip 630 includes a closure element 636 with closure portion 654 similar to the closure portion 154 in FIG. 3. The fastening strip 631 includes a closure element 634 with a closure portion 644 similar to closure portion 144 in FIG. 3. The fastening strip 630 also includes a closure portion 652 which is different from closure portion 152 in FIG. 3. Similarly, the fastening strip 631 also includes a closure portion 642 which is different from closure portion 142 in FIG. 3. The closure portions 642, 652 are known and described in U.S. Pat. Nos. 3,198,228 (which was reissued as Pat. Nos. Re. 28,969), 4,736,496 and 5,363,540 which are incorporated herein by reference. These closure portions are sometimes referred to as "arrowhead" closure portions. The remaining components of the fastening strips 630, 631 are similar to the components in fastening strips 130, 131.

FIG. 29 shows the fastening strips 630, 631 in a deoccluded position and FIG. 30 shows the fastening strips 630, 631 in an occluded position. The occlusion and deocclusion of the fastening strips 630, 631 is similar to the occlusion and deocclusion of the fastening strips 130, 131 noted above.

Figure 32:
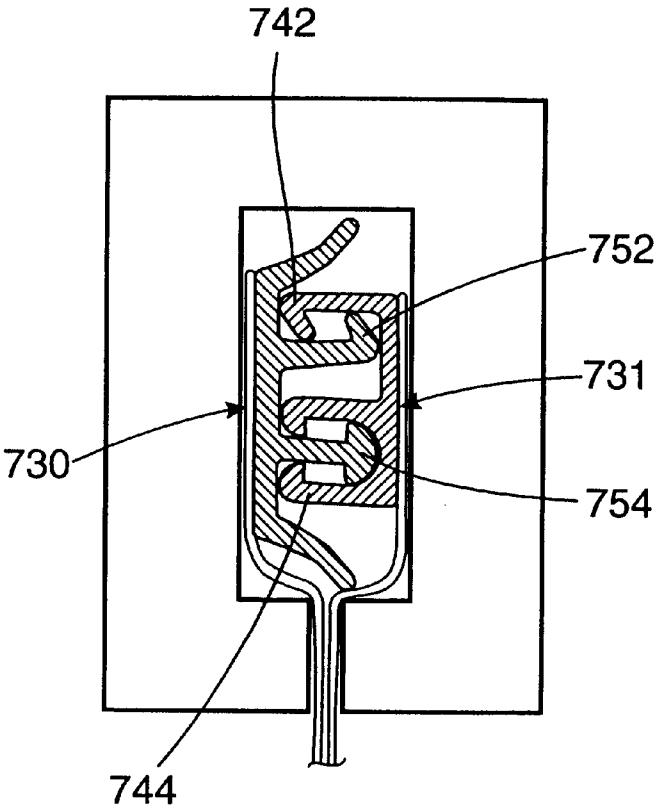
FIG. 32 is a cross-sectional view of the closure device in FIG. 31 in the occluded position.
Figure 31:
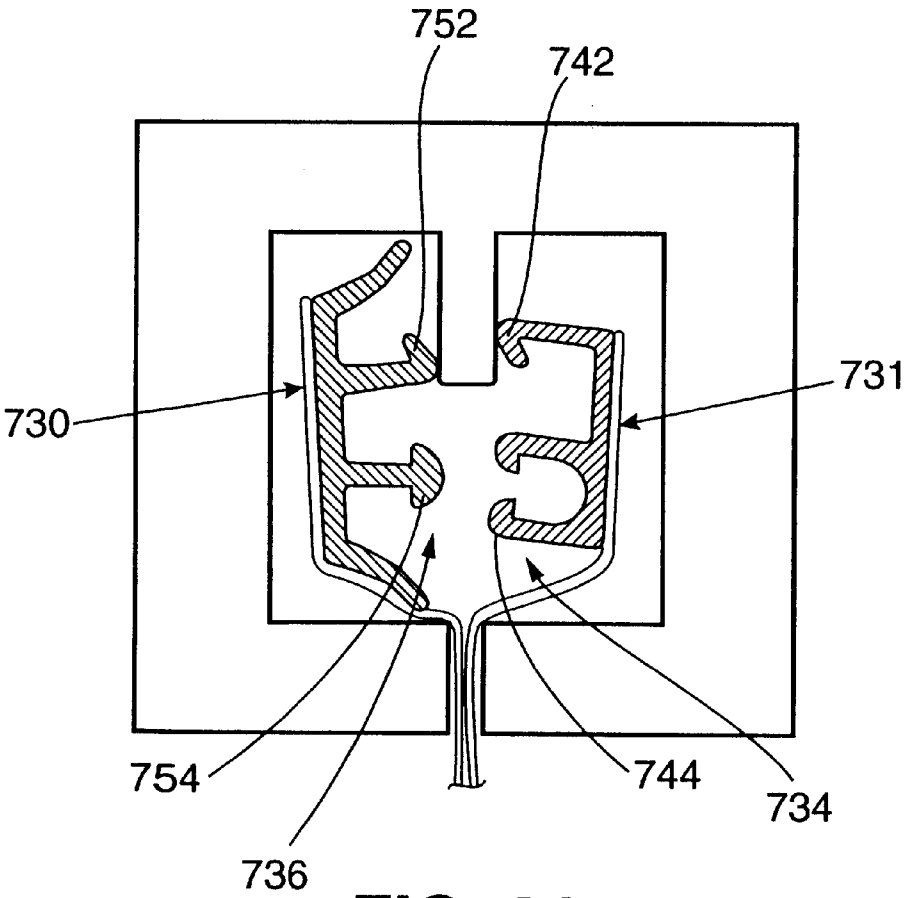
FIG. 31 is a cross-sectional view of another embodiment of the closure device according to this invention in a deoccluded position.

FIGS. 31 and 32 illustrate another embodiment of the closure device of the present invention. In this embodiment, the closure elements include inner arrowhead closure portions. Referring to FIG. 31, the fastening strip 730 includes a closure element 736 with closure portion 752 similar to the closure portion 152 in FIG. 3 and the fastening strip 731 includes closure element 734 with a closure portion 742 similar to closure portion 142 in FIG. 3. The closure element 736 also includes a closure portion 754 similar to closure portion 652 in FIG. 29. Similarly, the closure element 734 also includes a closure portion 744 similar to closure portion 642 in FIG. 29.

FIG. 31 shows the fastening strips 730, 731 in a deoccluded position and FIG. 32 shows the fastening strips 730, 731 in an occluded position. The occlusion and deocclusion of the fastening strips 730, 731 is similar to the occlusion and deocclusion of the fastening strips 130, 131 noted above.

Figure 34:
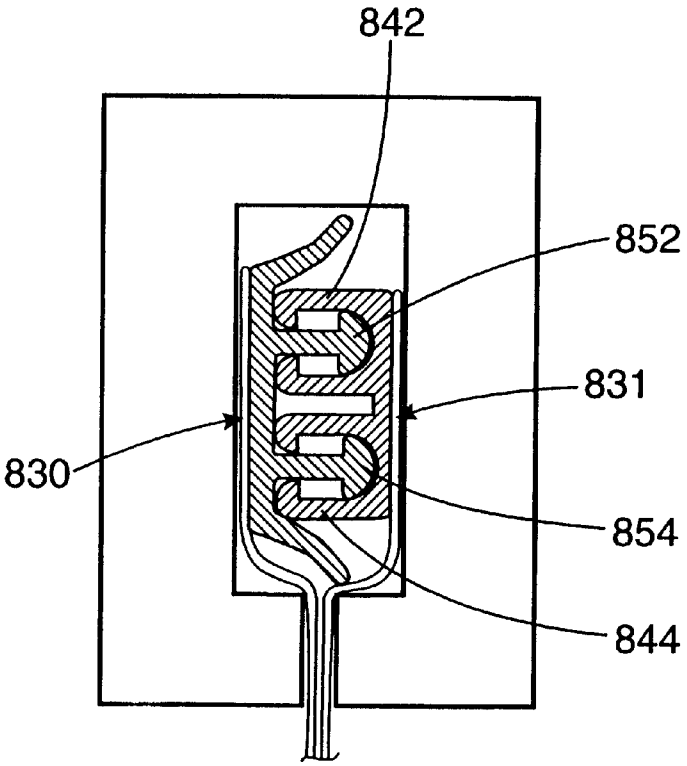
FIG. 34 is a cross-sectional view of the closure device in FIG. 33 in an occluded position.
Figure 33:
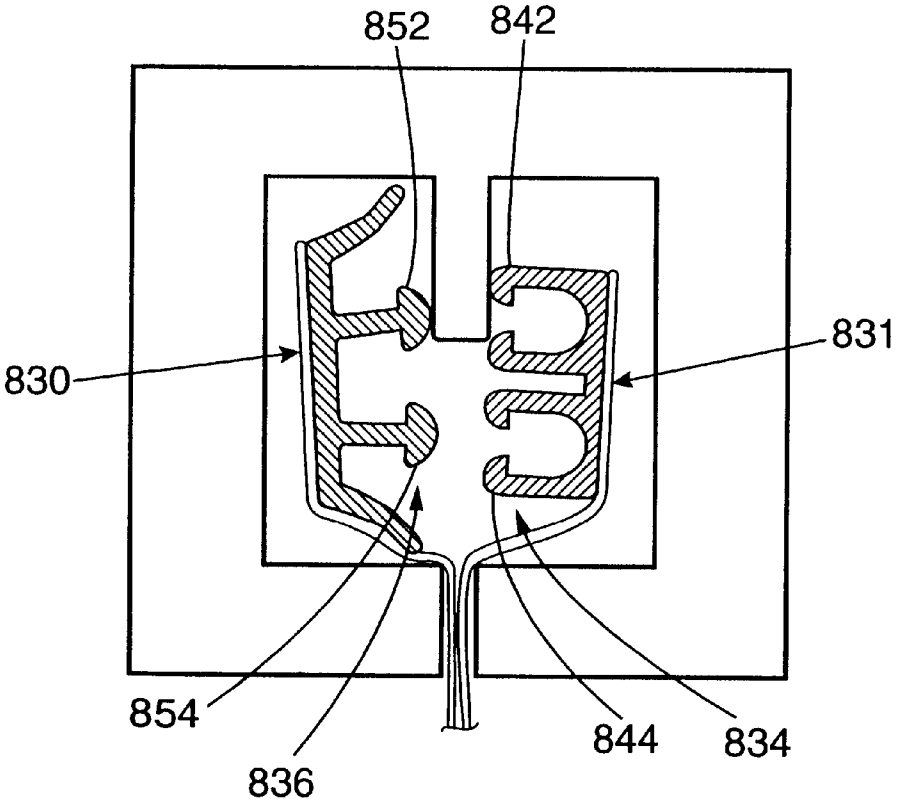
FIG. 33 is a cross-sectional view of another embodiment of the closure device according to this invention in a deoccluded position.

FIGS. 33 and 34 illustrate another embodiment of the closure device of the present invention. In this embodiment, the closure elements include inner and outer arrowhead closure portions. Referring to FIG. 33, the fastening strip 830 includes closure element 836 with an outer closure portion 852 similar to the outer closure portion 652 in FIG. 29 and the fastening strip 831 includes closure element 834 with an outer closure portion 842 similar to outer closure portion 642 in FIG. 29. The closure element 836 also includes a closure portion 854 similar to closure portion 754 in FIG. 31. Similarly, the closure element 834 also includes a closure portion 844 similar to closure portion 744 in FIG. 31.

FIG. 33 shows the fastening strips 830, 831 in a deoccluded position and FIG. 34 shows the fastening strips 830, 831 in an occluded position. The occlusion and deocclusion of the fastening strips 830, 831 is similar to the occlusion and deocclusion of the fastening strips 130, 131 noted above.

Another feature of this invention is to provide an additional seal near the seam for further sealing of the closure elements. Referring to FIGS. 35–38, the bag 620 includes a closure device 921 and sidewalls 922 joined at seams 925. The closure device 921 includes fastening strips 930, 931 and a slider 932. The sidewalls 922 and the fastening strips 930, 931 include an additional seal 934, 936 near the seams 925.

The fastening strips 930, 931 and the slider 932 are the same as the fastening strips 130, 131 and the slider 132 noted above except for the seal 934, 936. In addition, the fastening strips 930, 931 occlude and deocclude in the same way as fastening strips 130, 131 except when the fastening strips 930, 931 encounter the seal 934, 936.

Figure 35:
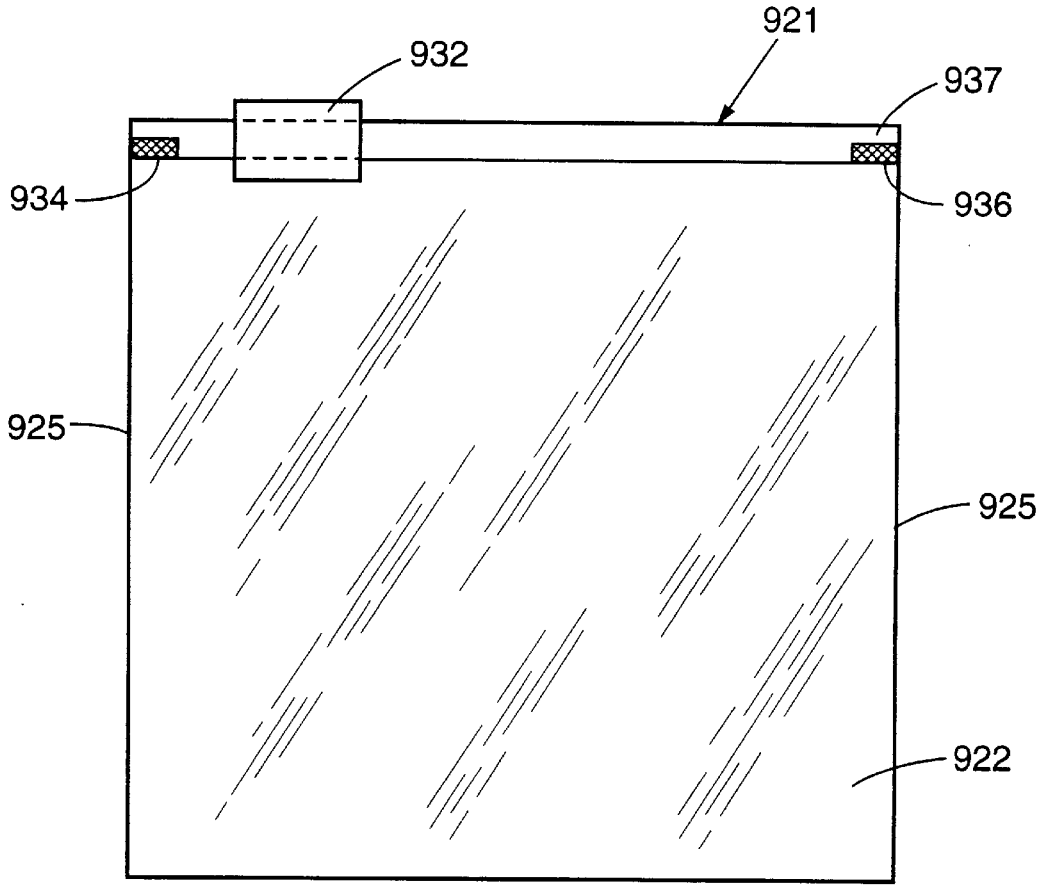
FIG. 35 is a front view of another embodiment of the container according to the present invention in the form of a plastic bag.
Figure 36:
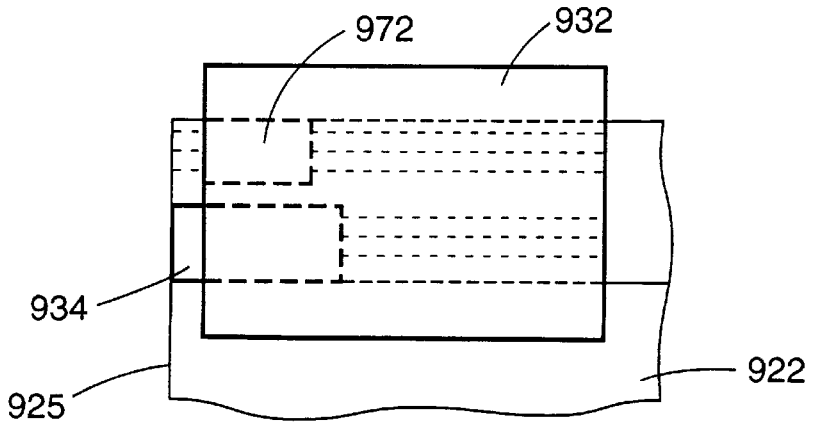
FIG. 36 is a partial front view of the slider of FIG. 35 in the end position.

The additional seal 934, 936 is formed by permanently attaching a portion of the fastening strips 930, 931 which are below the separator finger 972. The seal 934, 936 may be formed by heat sealing the fastening strips 930, 931 so that the closure portions 944, 954 and the inner webs 941, 951 are melted together as shown by comparing FIGS. 38–40 with FIGS. 41–43. Referring to FIGS. 35 and 36, the seal 934, 936 extends along the fastening strips and slightly beyond the length of the separator finger 972. However, in other embodiments the seal 934, 936 may be less than or equal to the length of the separator finger 972.

The fastening strips 930, 931 are shown with two seals 934, 936. However, only one seal is necessary. If only one seal is used, then the seal should be located near the seam where the slider will be positioned when the fastening strips are occluded throughout their length (i.e. seal 934). The other seal 936 can be eliminated or can be extended upwards at area 937 (see FIG. 35) to attach the outer webs 940, 950 and the closure portions 942, 952. For example, by extending the seal 936 upwards, the separator finger would contact the seal 936 and prevent the slider from further movement sooner than if the slider contacted the seam 925. The additional seal at area 937 could prevent a portion of the slider from extending over the seam 925.

Figure 37:
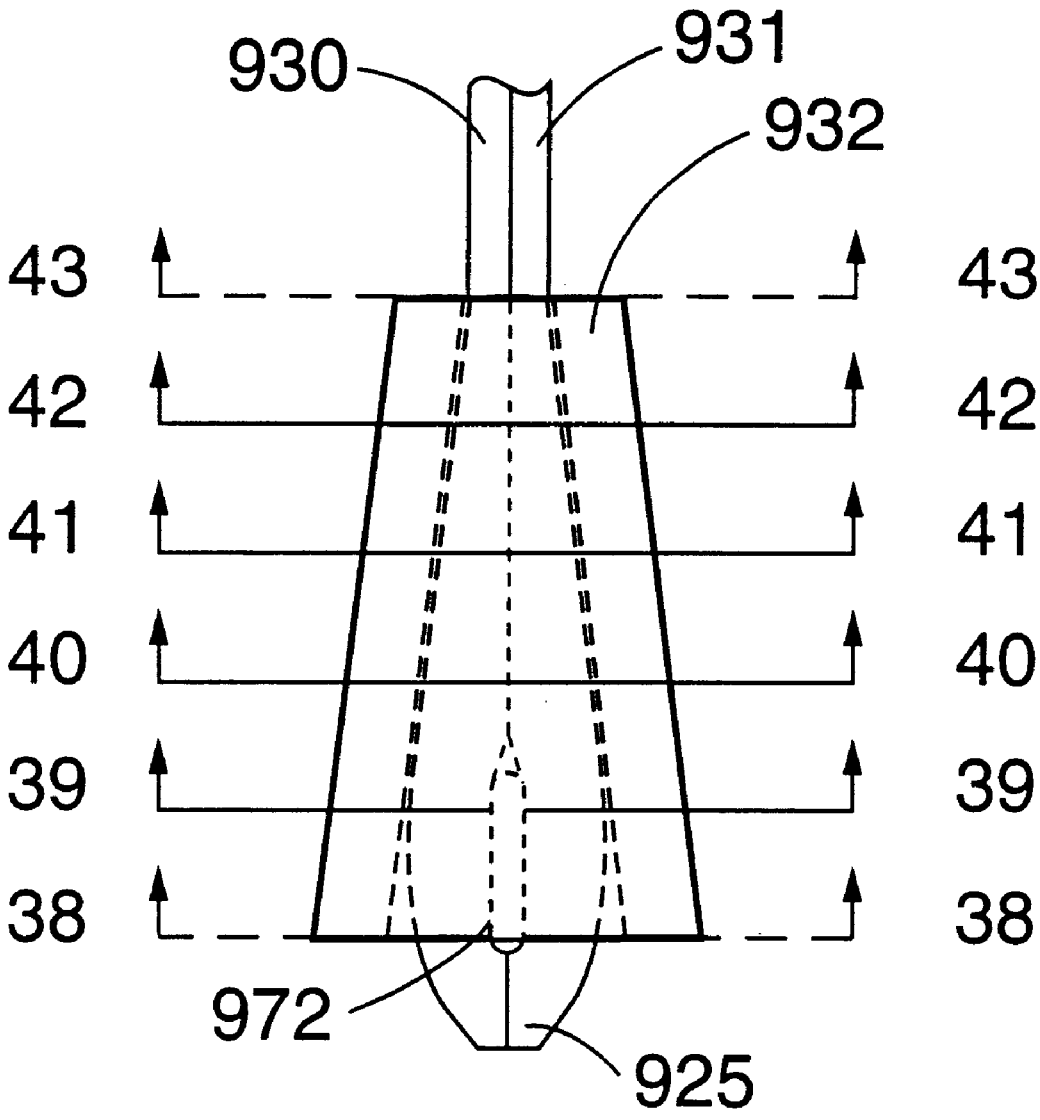
FIG. 37 is a top view of FIG. 36 with the slider in the end position and the fastening strips in the occluded position.

Referring to FIG. 37, the slider 932 is shown in the end position of the fastening strips 930, 931 near the seam 925. FIGS. 38–43 illustrate occlusion of the fastening strips 930, 931 in the end position using the seal 934. In accordance with the one feature of the invention, these figures demonstrate that the closure device will have a leak proof seal when the slider is in the end position using an additional seal. The leak proof seal is created even though the separator finger extends between the outer webs because the inner webs are occluded or permanently attached at the portion below the separator finger.

Figure 39:
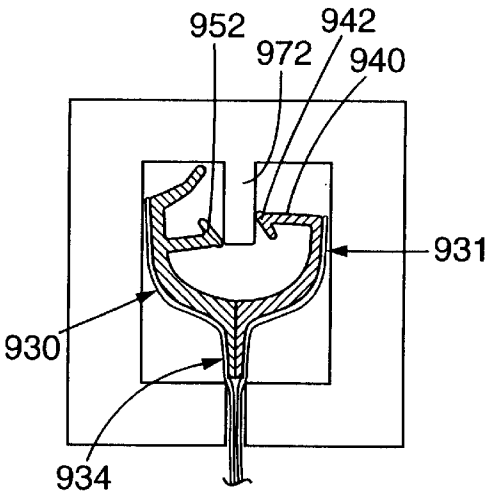
FIG. 39 is an enlarged cross sectional view taken along line 39—39 in FIG. 37.
Figure 40:
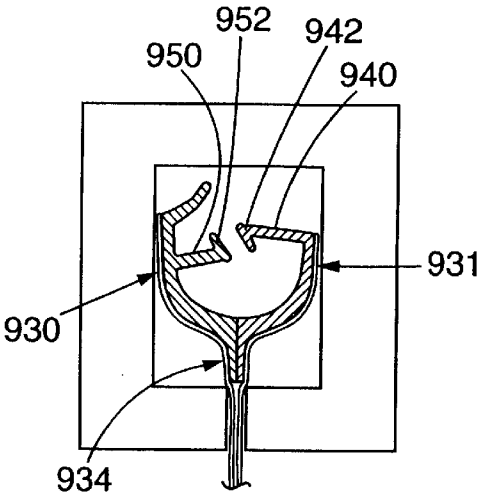
FIG. 40 is an enlarged cross sectional view taken along line 40—40 in FIG. 37.
Figure 41:
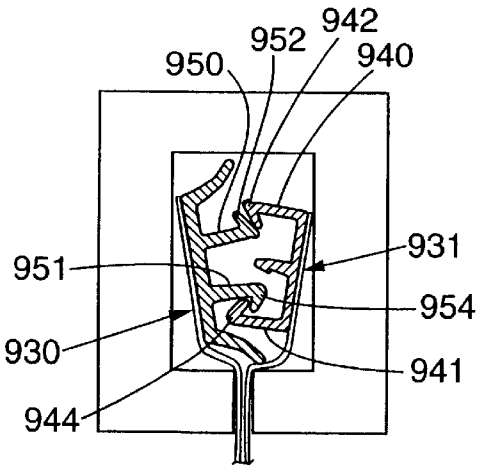
FIG. 41 is an enlarged cross sectional view taken along line 41—41 in FIG. 37.
Figure 42:
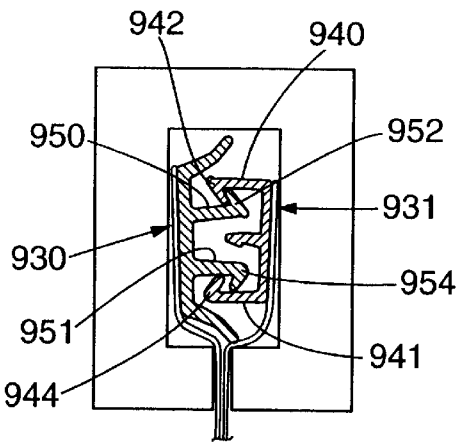
FIG. 42 is an enlarged cross sectional view taken along line 42—42 in FIG. 37.
Figure 43:
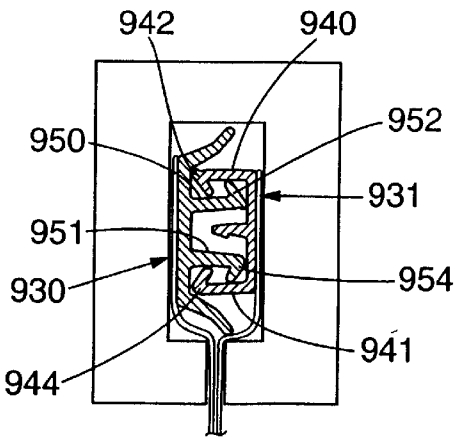
FIG. 43 is an enlarged cross sectional view taken along line 43—43 in FIG. 37.

Referring to FIGS. 38–43, the occlusion and deocclusion of the outer closure portions 942, 952 is substantially similar to the occlusion of the outer closure portions 142, 152 in FIGS. 15–20. Furthermore, the movement of inner closure portions 944, 954 in FIGS. 41–43 is substantially the same as the movement of the inner closure portions 144, 154 in FIGS. 18–20.

Figure 38:
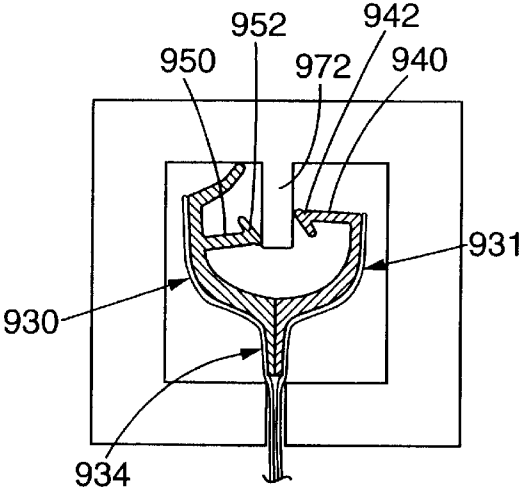
FIG. 38 is an enlarged cross sectional view taken along line 38—38 in FIG. 37.

However, as shown in FIGS. 38–40 a portion of the area below the separator finger 972 is permanently attached by the seal 934. More specifically, the inner closure portions 944, 954 are melted together so the closure portions 944, 954 do not exist in their previous form. The seal 934 prevents the separating action of the separator finger 972 from deocculding the seal 934 below the separator finger. Thus, the portion below the separator finger is sealed and the inner closure portions 944, 954 remain occluded through the length of the fastening strips to establish a leak proof seal. This leak proof seal is an improvement over the leak proof seal shown in FIGS. 15–20.

Figure 45:
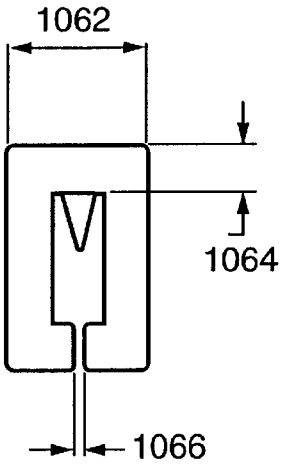
FIG. 45 illustrates a slider according to the present invention.
Figure 44:
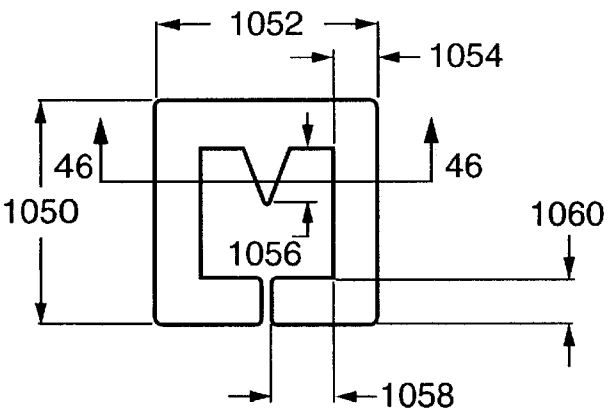
FIG. 44 illustrates a slider according to the present invention.
Figure 46:
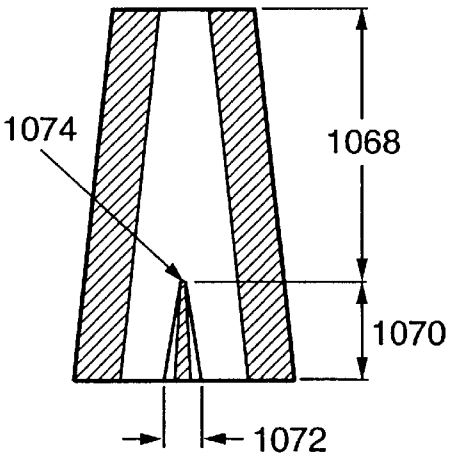
FIG. 46 illustrates a cross sectional view taken along line 46—46 in FIG. 44 of a slider according to the present invention.

FIGS. 44–46 illustrate one embodiment of a slider of the present invention. The representative dimensions of the various parameters are given as follows:

| PARAMETER | RANGE (mils) | PREFERRED (mils) |
|---|---|---|
| 1050 | 0.260–0.460 | 0.360 |
| 1052 | 0.200–0.400 | 0.300 |
| 1054 | 0.040–0.150 | 0.080 |
| 1056 | 0.075–0.125 | 0.100 |
| 1058 | 0.020–0.100 | 0.063 |
| 1060 | 0.040–0.150 | 0.080 |
| 1062 | 0.140–0.340 | 0.240 |
| 1064 | 0.040–0.150 | 0.08 |
| 1066 | 0.004–0.024 | 0.014 |
| 1068 | 0.250–0.650 | 0.450 |
| 1070 | 0.100–0.250 | 0.175 |
| 1072 | 0.020–0.080 | 0.050 |
| 1074 | 0.002–0.050 Radius | 0.005 Radius |

The slider may be manufactured by injection molding. The slider may be formed from thermoplastic materials such as, polypropylene, polyethylene, polyamide, polysulfone, ABS, PMMA, HDPE and Nylon.

Figure 48:
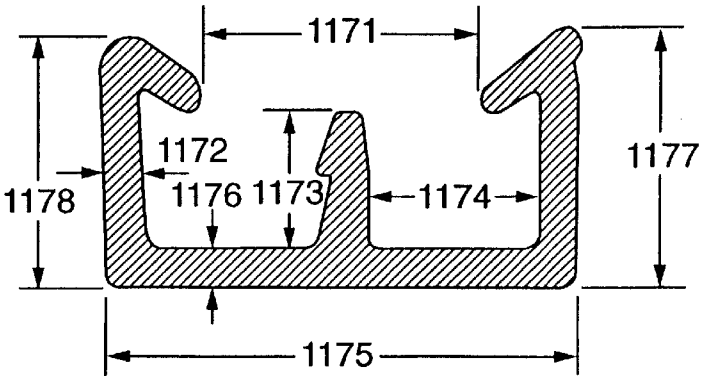
FIG. 48 illustrates a male fastening strip of a closure device according to the present invention.
Figure 47:
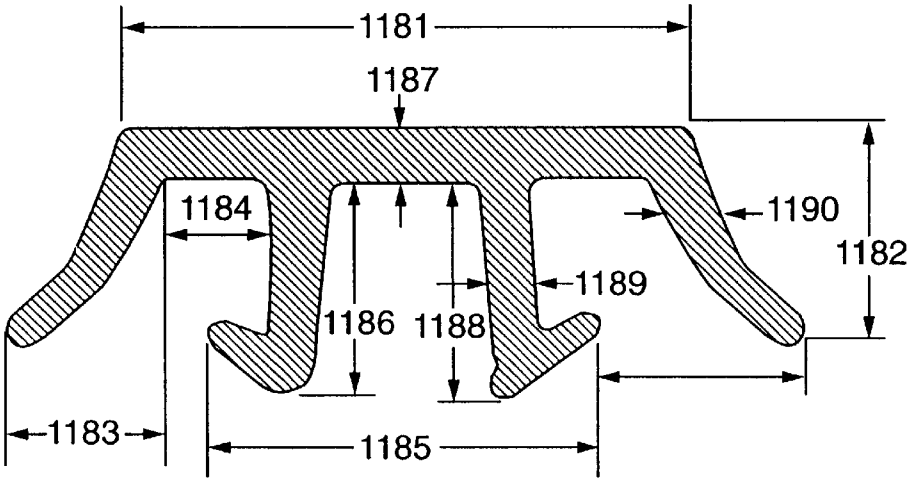
FIG. 47 illustrates a female fastening strip of a closure device according to the present invention.

FIGS. 47 and 48 illustrate the female and male fastening strips respectively of one embodiment of the closure device of the present invention. The representative dimensions of the various parameters are given as follows:

| PARAMETER | RANGE (inches) | PREFERRED (inches) |
|---|---|---|
| 1171 | 0.025–0.105 | 0.065 |
| 1172 | 0.010–0.016 | 0.013 |
| 1173 | 0.015–0.055 | 0.035 |
| 1174 | 0.019–0.059 | 0.039 |
| 1175 | 0.80–0.160 | 0.120 |
| 1176 | 0.010–0.016 | 0.013 |
| 1177 | 0.030–0.090 | 0.055 |
| 1178 | 0.03–0.090 | 0.055 |
| 1181 | 0.140–0.220 | 0.180 |
| 1182 | 0.020–0.070 | 0.045 |
| 1183 | 0.013–0.033 | 0.023 |
| 1184 | 0.015–0.065 | 0.040 |
| 1185 | 0.85–0.165 | 0.125 |
| 1186 | 0.032–0.062 | 0.047 |
| 1187 | 0.010–0.016 | 0.013 |
| 1188 | 0.033–0.063 | 0.047 |
| 1189 | 0.010–0.016 | 0.013 |
| 1190 | 0.010–0.016 | 0.013 |

The fastening strips may be manufactured by extrusion through a die that has the approximate dimensions given above, although the die should be made somewhat larger than the desired final dimensions of the fastening strip, inasmuch as shrinkage of the extruded fastening strip is likely upon cooling. The fastening strips of the closure device should be manufactured to have approximately uniform cross-sections. This not only simplifies the manufacturing of a device, but also contributes to the physical flexibility of the device, which is a desirable property in any event.

Generally, the closure elements of this invention may be formed from thermoplastic materials such as, for example, polyethylene, polypropylene, nylon, or the like, or from a combination thereof. Thus, resins or mixtures of resins such as high density polyethylene, medium density polyethylene and low density polyethylene may be employed to prepare the novel fastener of this invention. Preferably, the closure element is made from low density polyethylene. The selection of the thermoplastic material will be related to the closure design and its Young's Modulus and desired elasticity and flexibility correlated to provide the functionality of the closure as herein claimed.

When the fastener of the present invention is used in a sealable bag, the fastener and the films that form the body of the bag can be made from heat sealable material. The bag thus can be formed economically by heat sealing the aforementioned components to form the bag using thermoplastics of a type aforementioned for formation of the closure elements. Preferably, the bag is made from a mixture of high pressure, low density polyethylene and linear low density polyethylene.

The closure elements of the invention may be manufactured by extrusion or other known methods. The closure device can be manufactured as individual fastening strips for later attachment to a film, or the fastening strips can be manufactured integrally with a film. In addition, the closure elements can be manufactured with or without flange portions on one or both of the closure elements depending upon the intended use or expected additional manufacturing operations.

Generally, the closure device of this invention can be manufactured in a variety of forms to suit the intended use. In the practice of the instant invention, the closure device may be integrally formed with the sidewalls of a container, or connected to a container, by the use of any of many known methods. For example, a thermoelectric device can be applied to a film in contact with a flange portion of a closure element or the thermoelectric device can be applied to a film in contact with the base portion of a closure element having no flange portion, to cause a transfer of heat through the film to produce melting at the interface of the film and a flange portion or base portion of the closure element. The thermoelectric device can be heated rotary discs, traveling heater bands, resistance-heated slide wires, or the like. The connection between the film and the closure element can also be established by the use of hot melt adhesives, hot jets of air to the interface, ultrasonic heating, or other known methods. The bonding of the closure element to the film stock may be carried out either before or after the film is U-folded to form a bag. In any event, such bonding is done prior to side sealing the bags at the edges by conventional thermal cutting. In addition, the male and female closure elements can be positioned on opposite sides of a film. Such an embodiment would be suited for wrapping an object or a collection of objects such as wires. The male and female closure elements on a film generally should be parallel to each other, but this will depend on the intended use.

Thus, the present invention provides a closure device that overcomes the drawbacks inherent in the prior art. Specifically, the present invention affords a closure device with interlocking fastening strips and a slider which establishes a leak proof seal.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references and copending applications cited herein are hereby incorporated by reference in their entireties.

What is claimed is:

1. A closure device comprising:

first and second interlocking fastening strips arranged to be interlocked over a predetermined length, said first fastening strip includes a first closure element, said second fastening strip includes a second closure element;

a slider with a separator finger which slidably engages said first and second fastening strips, said slider facilitates the occlusion of said closure elements when moved towards a first end of said fastening strips, said separator finger extends into said closure elements without extending completely through said closure elements;

a portion of the first closure element and a portion of the second closure element are below the separator finger, said portions are occluded when the slider is at the first end of said fastening strips;

said first closure element comprises a first web and a second web, said first web spaced from said second web, said first web terminating in a first closure portion, said second web terminating in a second closure portion, said second closure element comprises a third web and a fourth web, said third web spaced from said fourth web, said third web terminating in a third closure portion which engages said first closure portion, said fourth web terminating in a fourth closure portion which engages said second closure portion, said portions of the closure elements below the separator finger are the second closure portion and the fourth closure portion, said separator finger extends between the first closure portion and the third closure portion; and wherein said first fastening strip includes a first wing and a second wing, said first wing and said second wing are disposed outside of the space between said first web and said second web.

2. The invention as in claim 1 wherein said first closure portion is a first male hook, said second second male hook facing away from said first male hook, said third closure portion is a first female hook, said is a second female hook facing toward said first female hook.

3. The invention as in claim 2 wherein said first closure element includes a first base, said first web and said second web are attached to said first base, said second closure element includes a second base, said third web and said fourth web are attached to said second base.

4. The invention as in claim 2 wherein said male hooks include guide surfaces to guide said male hooks with said female hooks.

5. The invention as in claim 2 wherein said female hooks include guide surfaces to guide said female hooks with said male hooks.

6. The invention as in claim 1 wherein said first closure portion is an arrowhead, said second hook, said third closure is a mating portion for said arrowhead, said fourth closure portion is a hook.

7. The invention as in claim 1 wherein said first closure portion is a hook, said second arrowhead, said third closure portion is a hook, said fourth closure portion is a mating portion for said arrowhead.

8. The invention as in claim 1 wherein said first closure portion is an arrowhead, said second arrowhead, said third closure portion is a mating portion for said arrowhead, said fourth closure portion is a mating arrowhead.

9. The invention as in claim 1 wherein said first closure portion is an arrowhead, said third mating configuration for said arrowhead, said fourth closure portion is an arrowhead, said second closure portion for said arrowhead.

10. The invention as in claim 4 wherein said first fastening strip includes a first base, said first web and said second web are attached to said first base, said second fastening strip includes a second base, said third web and said fourth web are attached to said base.

11. The invention as in claim 1 wherein said slider includes a top portion with an inner surface and an outer surface, said separator finger extends from said inner surface, a first side which extends from said top portion, said first side has an inner surface and an outer surface, a second side which extends from said top portion, said second side has an inner surface and an outer surface.

12. The invention as in claim 11 wherein said slider has a first end which corresponds with said first end of said fastening strips, said slider has a second end which corresponds with a second end of said fastening strips.

13. The invention as in claim 12 wherein said inner surface of said first side and said inner surface of said second side are separated by a distance, the distance near said first end of said slider is less than the distance near said second end of said slider.

14. The invention as in claim 13 wherein said separator finger is located near said second end of said slider.

15. The invention as in claim 13 wherein said slider has a length, said separator finger has a length, the length of said separator finger is less than the length of said slider.

16. The invention as in claim 15 wherein the length of said separator finger is less than half the length of said slider.

17. The invention as in claim 11 wherein said inner surface of said top portion of the slider lies in a first plane, said inner surface of said first side of said slider lies in a second plane, said inner surface of said second side of said slider lies in a third plane.

18. The invention as in claim 17 wherein said second plane is substantially perpendicular to said first plane.

19. The invention as in claim 17 wherein said third plane is substantially perpendicular to said first plane.

20. The invention as in claim 17 wherein said second plane is substantially perpendicular to said first plane and said third plane is substantially perpendicular to said first plane.

21. The invention as in claim 12 wherein said slider includes a bottom portion with an inner surface and an outer surface, said bottom portion includes a slot.

22. The invention as in claim 21 wherein said slot extends from said first end of said slider to said second end of said slider.

23. The invention as in claim 22 wherein said slot has a width, the width of said slot is substantially the same from the first end of said slider to said second end of said slider.

24. The invention as in claim 21 wherein said bottom portion is separated from said top portion by a first distance, the separator finger extends from said inner surface of said top portion by a second distance, said second distance is less than said first distance.

25. The invention as in claim 24 wherein said second distance is less than half the first distance.

26. The invention as in claim 24 wherein said second distance is substantially the same along the length of the separator finger.

27. The invention as in claim 24 wherein said second distance varies along the length of the separator finger.

28. The invention as in claim 27 wherein said second distance decreases along the length of the separator finger.

29. The invention as in claim 1 wherein said slider has a top portion, said separator finger extends from said top portion by a distance.

30. The invention as in claim 29 wherein said distance is substantially the same along the length of the separator finger.

31. The invention as in claim 29 wherein said distance varies along the length of the separator finger.

32. The invention as in claim 31 wherein said distance decreases along the length of the separator finger.

33. The invention as in claim 1 wherein said separator finger has a first side portion and a second side portion, said first side portion is parallel to said second side portion.

34. The invention as in claim 1 wherein said separator finger has a first side portion and a second side portion, said first side portion is unparallel to said second side portion.

35. The invention as in claim 34 wherein said first side portion and said second side portion taper toward each other.

36. The invention as in claim 34 wherein said first side portion and said second side portion are separated by a first distance at a first location and separated by a second distance at a second location, said first distance is greater than said second distance.

37. The invention as in claim 1 wherein said separator finger has a top portion and a bottom portion, said top portion has a first width and said bottom portion has a second width.

38. The invention as in claim 37 wherein said first width is equal to said second width.

39. The invention as in claim 37 wherein said first width is greater than said second width.

40. The invention as in claim 1 wherein said first fastening strip includes a color different than said second fastening strip.

41. The invention as in claim 40 wherein at least a portion of one of said fastening strips is translucent.

42. The invention as in claim 40 wherein said first fastening strip includes a first color and said second fastening strip includes a second color and said fastening strips provide a third color when said fastening strips are occluded.

43. The invention as in claim 40 wherein said first fastening strip includes a color change enhancement member.

44. The invention as in claim 43 wherein said color change enhancement member is integrally associated with said first fastening strip.

45. The invention as in claim 1 wherein said fastening strips are attached together at a seam, said slider is prevented from further movement in the direction toward the seam when said separator finger engages said seam.

46. The invention as in claim 1 wherein a portion of the first fastening strip and a portion of the second fastening strip are below the separator finger when the slider is at the first end of the fastening strips, said portions are permanently attached together.

47. The invention as in claim 46 wherein said portions are attached by heat sealing.

48. The invention as in claim 47 wherein said first closure element comprises a first closure portion and a second closure portion, said second closure element comprises a third closure portion and a fourth closure portion, said third closure portion engages said first closure portion, said fourth closure portion engages said second closure portion, said portions of the fastening strips below the separator finger are the second closure portion and the fourth closure portion, said separator finger extends between the first closure portion and the third closure portion, said second closure portion and said fourth closure portion are melted together at said first end of the fastening strips.

49. A container comprising first and second sidewalls, said first and second sidewalls including first and second fastening strips respectively, said first and second fastening strips comprising a closure device arranged to be interlocked over a predetermined length, said first fastening strip includes a first closure element, said second fastening strip includes a second closure element, a slider with a separator finger which slidably engages said first and second fastening strips, said slider facilitates the occlusion of said closure elements when moved towards a first end of said fastening strips, said separator finger extends into said closure elements without extending completely through said closure elements;

wherein portions of the closure elements are below the separator finger, said portions are occluded when the slider is at the first end of said fastening strips;

wherein said first closure element comprises a first web and a second web, said first web spaced from said second web, said first web terminating in a first closure portion, said second web terminating in a second closure portion, said second closure element comprises a third web and a fourth web, said third web spaced from said fourth web, said third web terminating in a third closure portion which engages said first closure portion, said fourth web terminating in a fourth closure portion which engages said second closure portion, said portions of the closure elements below the separator finger are the second closure portion and the fourth closure portion, said separator finger extends between the first closure portion and the third closure portion; and wherein said first fastening strip includes a first wing and a second wing, said first wing and said second wing are disposed outside of the space between said first web and said second web.

50. The invention as in claim 49 wherein said first closure portion is a first male hook, said second closure portion is a second male hook facing away from said first male hook, said third closure portion is a first female hook, said fourth closure portion is a second female hook facing toward said first female hook.

51. The invention as in claim 50 wherein said first closure element includes a first base, said first web and said second web are attached to said first base, said second closure element includes a second base, said third web and said fourth web are attached to said second base.

52. The invention as in claim 50 wherein said male hooks include guide surfaces to guide said male hooks with said female hooks.

53. The invention as in claim 50 wherein said female hooks include guide surfaces to guide said female hooks with said male hooks.

54. The invention as in claim 49 wherein said first closure portion is an arrowhead, said second closure portion is a hook, said third closure is a mating portion for said arrowhead, said fourth closure portion is a hook.

55. The invention as in claim 49 wherein said first closure portion is a hook, said second closure portion is an arrowhead, said third closure portion is a hook, said fourth closure portion is a mating portion for said arrowhead.

56. The invention as in claim 49 wherein said first closure portion is an arrowhead, said second closure portion is an arrowhead, said third closure portion is a mating portion for said arrowhead, said fourth closure portion is a mating portion for said arrowhead.

57. The invention as in claim 49 wherein said first closure portion is an arrowhead, said third closure portion is a mating configuration for said arrowhead, said fourth closure portion is an arrowhead, said second closure portion is a mating portion for said arrowhead.

58. The invention as in claim 52 wherein said first fastening strip includes a first base, said first web and said second web are attached to said first base, said second fastening strip includes a second base, said third web and said fourth web are attached to said base.

59. The invention as in claim 49 wherein said slider includes a top portion with an inner surface and an outer surface, said separator finger extends from said inner surface, a first side which extends from said top portion, said first side has an inner surface and an outer surface, a second side which extends from said top portion, said second side has an inner surface and an outer surface.

60. The invention as in claim 59 wherein said slider has a first end which corresponds with said first end of said fastening strips, said slider has a second end which corresponds with a second end of said fastening strips.

61. The invention as in claim 60 wherein said inner surface of said first side and said inner surface of said second side are separated by a distance, the distance near said first end of said slider is less than the distance near said second end of said slider.

62. The invention as in claim 61 wherein said separator finger is located near said second end of said slider.

63. The invention as in claim 61 wherein said slider has a length, said separator finger has a length, the length of said separator finger is less than the length of said slider.

64. The invention as in claim 63 wherein the length of said separator finger is less than half the length of said slider.

65. The invention as in claim 59 wherein said inner surface of said top portion of the slider lies in a first plane, said inner surface of said first side of said slider lies in a second plane, said inner surface of said second side of said slider lies in a third plane.

66. The invention as in claim 65 wherein said second plane is substantially perpendicular to said first plane.

67. The invention as in claim 65 wherein said third plane is substantially perpendicular to said first plane.

68. The invention as in claim 65 wherein said second plane is substantially perpendicular to said first plane and said third plane is substantially perpendicular to said first plane.

69. The invention as in claim 60 wherein said slider includes a bottom portion with an inner surface and an outer surface, said bottom portion includes a slot.

70. The invention as in claim 69 wherein said slot extends from said first end of said slider to said second end of said slider.

71. The invention as in claim 70 wherein said slot has a width, the width of said slot is substantially the same from the first end of said slider to said second end of said slider.

72. The invention as in claim 69 wherein said bottom portion is separated from said top portion by a first distance, the separator finger extends from said inner surface of said top portion by a second distance, said second distance is less than said first distance.

73. The invention as in claim 72 wherein said second distance is less than half the first distance.

74. The invention as in claim 72 wherein said second distance is substantially the same along the length of the separator finger.

75. The invention as in claim 72 wherein said second distance varies along the length of the separator finger.

76. The invention as in claim 75 wherein said second distance decreases along the length of the separator finger.

77. The invention as in claim 49 wherein said slider has a top portion, said separator finger extends from said top portion by a distance.

78. The invention as in claim 77 wherein said distance is substantially the same along the length of the separator finger.

79. The invention as in claim 77 wherein said distance varies along the length of the separator finger.

80. The invention as in claim 79 wherein said distance decreases along the length of the separator finger.

81. The invention as in claim 49 wherein said separator finger has a first side portion and a second side portion, said first side portion is parallel to said second side portion.

82. The invention as in claim 49 wherein said separator finger has a first side portion and a second side portion, said first side portion is unparallel to said second side portion.

83. The invention as in claim 82 wherein said first side portion and said second side portion taper toward each other.

84. The invention as in claim 82 wherein said first side portion and said second side portion are separated by a first distance at a first location and separated by a second distance at a second location, said first distance is greater than said second distance.

85. The invention as in claim 49 wherein said separator finger has a top portion and a bottom portion, said top portion has a first width and said bottom portion has a second width.

86. The invention as in claim 85 wherein said first width is equal to said second width.

87. The invention as in claim 85 wherein said first width is greater than said second width.

88. The invention as in claim 49 wherein said first fastening strip includes a color different than said second fastening strip.

89. The invention as in claim 88 wherein at least a portion of one of said fastening strips is translucent.

90. The invention as in claim 88 wherein said first fastening strip includes a first color and said second fastening strip includes a second color and said fastening strips provide a third color when said fastening strips are occluded.

91. The invention as in claim 88 wherein said first fastening strip includes a color change enhancement member.

92. The invention as in claim 91 wherein said color change enhancement member is integrally associated with said first fastening strip.

93. The invention as in claim 49 wherein said fastening strips are attached together at a seam, said slider is prevented from further movement in the direction toward the seam when said separator finger engages said seam.

94. The invention as in claim 49 wherein portions of the fastening strips are below the separator finger when the slider is at the first end of the fastening strips, said portions are permanently attached together.

95. The invention as in claim 94 wherein said portions are attached by heat sealing.

96. The invention as in claim 95 wherein said first closure element comprises a first web and a second web, said first web spaced from said second web, said first web terminating in first closure portion, said second web terminating in a second closure portion, said second closure element comprises a third web and a fourth web, said third web spaced from said fourth web, said third web terminating in a third closure portion which engages said first closure portion, said fourth web terminating in a fourth closure portion which engages said second closure portion, said portions of the fastening strips below the separator finger are the second web and the fourth web, said separator finger extends between the first web and the third web, said second web and said fourth web are melted together at said first end of the fastening strips.

* * * * *